US008258391B2

(12) United States Patent
Taub et al.

(10) Patent No.: US 8,258,391 B2
(45) Date of Patent: Sep. 4, 2012

(54) MUSIC TRANSCRIPTION

(75) Inventors: Robert D. Taub, Princeton, NJ (US); J. Alexander Cabanilla, New York, NY (US)

(73) Assignee: MuseAmi, Inc., Princeton, NJ (US)

( * ) Notice: Subject to any disclaimer, the term of this patent is extended or adjusted under 35 U.S.C. 154(b) by 0 days.

(21) Appl. No.: 13/156,667

(22) Filed: Jun. 9, 2011

(65) Prior Publication Data

US 2011/0232461 A1 Sep. 29, 2011

Related U.S. Application Data

(60) Continuation of application No. 12/710,134, filed on Feb. 22, 2010, now Pat. No. 7,982,119, which is a division of application No. 12/024,981, filed on Feb. 1, 2008, now Pat. No. 7,667,125.

(60) Provisional application No. 60/887,738, filed on Feb. 1, 2007.

(51) Int. Cl.
*G10H 1/00* (2006.01)

(52) U.S. Cl. ..... 84/616; 84/654

(58) Field of Classification Search ..... 84/600–602, 84/609, 616, 649, 654
See application file for complete search history.

(56) References Cited

U.S. PATENT DOCUMENTS

| | | | | |
|---|---|---|---|---|
| 5,808,225 | A * | 9/1998 | Corwin et al. | 84/622 |
| 6,140,568 | A * | 10/2000 | Kohler | 84/616 |
| 7,547,840 | B2 * | 6/2009 | Noh et al. | 84/601 |
| 7,667,125 | B2 * | 2/2010 | Taub et al. | 84/616 |
| 7,982,119 | B2 * | 7/2011 | Taub et al. | 84/609 |

* cited by examiner

*Primary Examiner* — Elvin G Enad
*Assistant Examiner* — Andrew R Millikin
(74) *Attorney, Agent, or Firm* — Kilpatrick Townsend & Stockton LLP

(57) ABSTRACT

Methods, systems, and devices are described for automatically converting audio input signal data into musical score representation data. Embodiments of the invention identify a change in frequency information from the audio signal that exceeds a first threshold value; identify a change in amplitude information from the audio signal that exceeds a second threshold value; and generate a note onset event, each note onset event representing a time location in the audio signal of at least one of an identified change in the frequency information that exceeds the first threshold value or an identified change in the amplitude information that exceeds the second threshold value. The generation of note onset events and other information from the audio input signal may be used to extract note pitch, note value, tempo, meter, key, instrumentation, and other score representation information.

6 Claims, 17 Drawing Sheets

1106

| | | 72 bpm | 76 bpm | 80 bpm | 84 bpm | 88 bpm | 92 bpm | 96 bpm | 100 bpm |
|---|---|---|---|---|---|---|---|---|---|
| 1/16 NOTE | Seconds | 0.2083 | 0.1974 | 0.1875 | 0.1786 | 0.1705 | 0.1630 | 0.1563 | 0.1500 |
| | Samples | 9188 | 8704 | 8269 | 7875 | 7517 | 7190 | 6891 | 6615 |
| 1/8 NOTE | Seconds | 0.4167 | 0.3947 | 0.3750 | 0.3571 | 0.3409 | 0.3261 | 0.3125 | 0.3000 |
| | Samples | 18375 | 17408 | 16538 | 15750 | 15034 | 14380 | 13781 | 13230 |
| 1/4 NOTE | Seconds | 0.8333 | 0.7895 | 0.7500 | 0.7143 | 0.6818 | 0.6522 | 0.6250 | 0.6000 |
| | Samples | 36750 | 34816 | 33075 | 31500 | 30068 | 28761 | 27563 | 26460 |
| 1/2 NOTE | Seconds | 1.6667 | 1.5789 | 1.5000 | 1.4286 | 1.3636 | 1.3043 | 1.2500 | 1.2000 |
| | Samples | 73500 | 69632 | 66150 | 63000 | 60136 | 57522 | 55125 | 52920 |

1104

1400

| | | C | C#/Db | D | D#/Eb | E | F | F#/Gb | G | G#/Ab | A | A#/Bb | B |
|---|---|---|---|---|---|---|---|---|---|---|---|---|---|
| 1402-1 | C Major | 1 | 0 | 1 | 0 | 1 | 1 | 0 | 1 | 0 | 1 | 0 | 1 |
| 1402-2 | C Minor | 1 | 0 | 1 | 1 | 0 | 1 | 0 | 1 | 1 | 0 | 1 | 0 |
| 1402-3 | D Major | 0 | 1 | 1 | 0 | 1 | 0 | 1 | 1 | 0 | 1 | 0 | 1 |
| | A Minor | 1 | 0 | 1 | 0 | 1 | 1 | 0 | 1 | 0 | 1 | 0 | 1 |

FIG. 14A

1450

| | | C | C#/Db | D | D#/Eb | E | F | F#/Gb | G | G#/Ab | A | A#/Bb | B |
|---|---|---|---|---|---|---|---|---|---|---|---|---|---|
| 1452-1 | C Major | 2 | 0 | 1 | 0 | 2 | 1 | 0 | 2 | 0 | 1 | 0 | 1 |
| 1452-2 | C Minor | 2 | 0 | 1 | 2 | 0 | 1 | 0 | 2 | 1 | 0 | 1 | 0 |
| 1452-3 | D Major | 0 | 2 | 1 | 0 | 1 | 0 | 2 | 1 | 0 | 2 | 0 | 1 |
| | A Minor | 2 | 0 | 1 | 0 | 2 | 1 | 0 | 1 | 0 | 2 | 0 | 1 |

FIG. 14B

MUSIC TRANSCRIPTION

CROSS REFERENCES

This application is a continuation of U.S. patent application Ser. No. 12/710,134 filed Feb. 22, 2010 entitled "MUSIC TRANSCRIPTION", which is a divisional of application Ser. No. 12/024,981 filed Feb. 1, 2008, entitled "MUSIC TRANSCRIPTION" (now U.S. Pat. No. 7,667,125 issued Feb. 23, 2010), which claims priority from U.S. Provisional Patent Application No. 60/887,738 filed Feb. 1, 2007 entitled "MUSIC TRANSCRIPTION". This application is related to U.S. patent application Ser. No. 12/710,148 filed Feb. 22, 2010 entitled "MUSIC TRANSCRIPTION" (now U.S. Pat. No. 7,884,276), which also claims priority from U.S. patent application Ser. No. 12/024,981 filed Feb. 1, 2008, entitled "MUSIC TRANSCRIPTION" (now U.S. Pat. No. 7,667,125 issued Feb. 23, 2010), which claims priority from U.S. Provisional Patent Application No. 60/887,738 filed Feb. 1, 2007 entitled "MUSIC TRANSCRIPTION". These applications are hereby incorporated by reference, as if set forth in full in this document, for all purposes.

BACKGROUND

The present invention relates to audio applications in general and, in particular, to audio decomposition and score generation.

It may be desirable to provide accurate, real time conversion of raw audio input signals into score data for transcription. For example, a musical performer (e.g., live or recorded, using vocals and/or other instruments) may wish to automatically transcribe a performance to generate sheet music or to convert the performance to an editable digital score file. Many elements may be part of the musical performance, including notes, timbres, modes, dynamics, rhythms, and tracks. The performer may require that all these elements are reliably extracted from the audio file to generate an accurate score.

Conventional systems generally provide only limited capabilities in these areas, and even those capabilities generally provide outputs with limited accuracy and timeliness. For example, many conventional systems require the user to provide data to the system (other than an audio signal) to help the system convert an audio signal to useful score data. One resulting limitation is that it may be time-consuming or undesirable to provide data to the system other than the raw audio signal. Another resulting limitation is that the user may not know much of the data required by the system (e.g., the user may not be familiar with music theory). Yet another resulting limitation is that the system may have to provide extensive user interface capabilities to allow for the provision of required data to the system (e.g., the system may have to have a keyboard, display, etc.).

It may be desirable, therefore, to provide improved capabilities for automatically and accurately extracting score data from a raw audio file.

SUMMARY

Methods, systems, and devices are described for automatically and accurately extracting score data from an audio signal. A change in frequency information from the audio input signal that exceeds a first threshold value is identified and a change in amplitude information from the audio input signal that exceeds a second threshold value is identified. A note onset event is generated such that each note onset event represents a time location in the audio input signal of at least one of an identified change in the frequency information that exceeds the first threshold value or an identified change in the amplitude information that exceeds the second threshold value. The techniques described herein may be implemented in methods, systems, and computer-readable storage media having a computer-readable program embodied therein.

In one aspect of the invention, an audio signal is received from one or more audio sources. The audio signal is processed to extract frequency and amplitude information. The frequency and amplitude information is used to detect note onset events (i.e., time locations where a musical note is determined to begin). For each note onset event, envelope data, timbre data, pitch data, dynamic data, and other data are generated. By examining data from sets of note onset events, tempo data, meter data, key data, global dynamics data, instrumentation and track data, and other data are generated. The various data are then used to generate a score output.

In yet another aspect, tempo data is generated from an audio signal and a set of reference tempos are determined. A set of reference note durations are determined, each reference note duration representing a length of time that a predetermined note type lasts at each reference tempo, and a tempo extraction window is determined, representing a contiguous portion of the audio signal extending from a first time location to a second time location. A set of note onset events are generated by locating the note onset events occurring within the contiguous portion of the audio signal; generating a note spacing for each note onset event, each note spacing representing the time interval between the note onset event and the next-subsequent note onset event in the set of note onset events; generating a set of error values, each error value being associated with an associated reference tempo, wherein generating the set of error values includes dividing each note spacing by each of the set of reference note durations, rounding each result of the dividing step to a nearest multiple of the reference note duration used in the dividing step, and evaluating the absolute value of the difference between each result of the rounding step and each result of the dividing step; identifying a minimum error value of the set of error values; and determining an extracted tempo associated with the tempo extraction window, wherein the extracted tempo is the associated reference tempo associated with the minimum error value. Temp data may be further generated by determining a set of second reference note durations, each reference note duration representing a length of time that each of a set of predetermined note types lasts at the extracted tempo; generating a received note duration for each note onset event; and determining a received note value for each received note duration, the received note value representing the second reference note duration that best approximates the received note duration.

In still another aspect, a technique for generating key data from an audio signal includes determining a set of cost functions, each cost function being associated with a key and representing a fit of each of a set of predetermined frequencies to the associated key; determining a key extraction window, representing a contiguous portion of the audio signal extending from a first time location to a second time location; generating a set of note onset events by locating the note onset events occurring within the contiguous portion of the audio signal; determine a note frequency for each of the set of note onset events; generating a set of key error values based on evaluating the note frequencies against each of the set of cost functions; and determining a received key, wherein the received key is the key associated with the cost function that generated the lowest key error value. In some embodiments, the method further includes generating a set of reference pitches, each reference pitch representing a relationship between one of the set of predetermined pitches and the received key; and determining a key pitch designation for each note onset event, the key pitch designation representing the reference pitch that best approximates the note frequency of the note onset event.

In still another aspect, a technique for generating track data from an audio signal includes generating a set of note onset events, each note onset event being characterized by at least one set of note characteristics, the set of note characteristics including a note frequency and a note timbre; identifying a number of audio tracks present in the audio signal, each audio track being characterized by a set of track characteristics, the set of track characteristics including at least one of a pitch map or a timbre map; and assigning a presumed track for each set of note characteristics for each note onset event, the presumed track being the audio track characterized by the set of track characteristics that most closely matches the set of note characteristics.

Other features and advantages of the present invention should be apparent from the following description of preferred embodiments that illustrate, by way of example, the principles of the invention.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

FIGS. 14A and 14B provide illustrations of two exemplary key cost functions used in key detection according to embodiments of the invention.

DETAILED DESCRIPTION

This description provides example embodiments only, and is not intended to limit the scope, applicability, or configuration of the invention. Rather, the ensuing description of the embodiments will provide those skilled in the art with an enabling description for implementing embodiments of the invention. Various changes may be made in the function and arrangement of elements without departing from the spirit and scope of the invention.

Thus, various embodiments may omit, substitute, or add various procedures or components as appropriate. For instance, it should be appreciated that in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner.

It should also be appreciated that the following systems, methods, and software may individually or collectively be components of a larger system, wherein other procedures may take precedence over or otherwise modify their application. Also, a number of steps may be required before, after, or concurrently with the following embodiments.

Figure 1A:
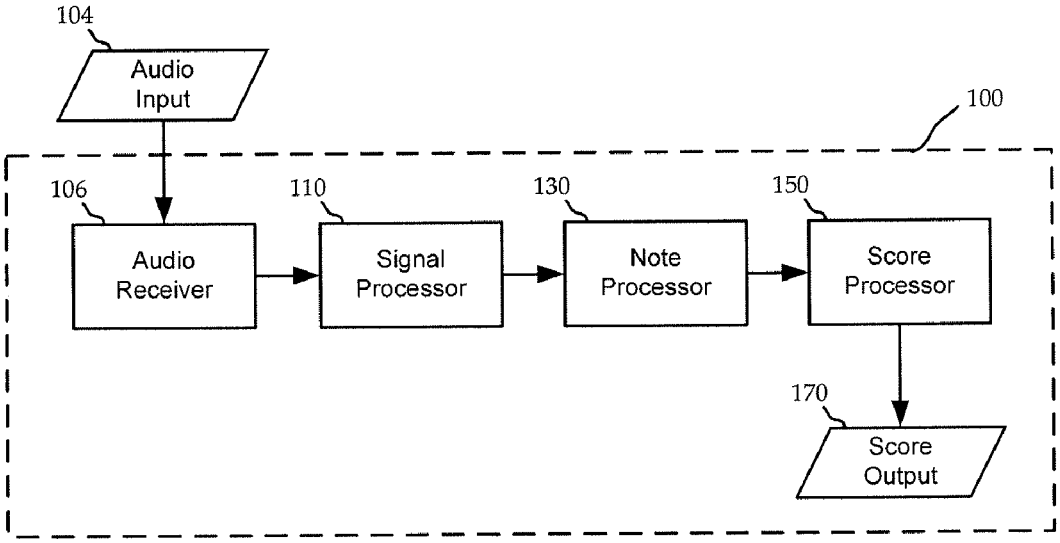
FIG. 1A provides a high-level simplified block diagram of a system according to the present invention.

FIG. 1A shows a high-level simplified block diagram of a system constructed in accordance with the invention for automatically and accurately extracting score data from an audio signal according to the invention. The system 100 receives an audio input signal 104 at an audio receiver unit 106 and passes the signal through a signal processor unit 110, a note processor unit 130, and a score processor unit 150. The score processor unit 150 may then generate score output 170.

In accordance with some embodiments of the invention, the system 100 may receive a composition or performance as an audio input signal 104 and generate the corresponding music score representation 170 of the performance. The audio input signal 104 may be from a live performance or can include playback from a recorded performance, and involve both musical instruments and human voice. Music score representations 170 can be produced for each of the different instruments and voices that make up an audio input signal

104. The music score representation 170 may provide, for example, pitch, rhythm, timbre, dynamics, and/or any other useful score information.

In some embodiments, instruments and voices, alone or in combination, will be discerned from the others according to the frequencies at which the instruments and voices are performing (e.g., through registral differentiation) or by differentiating between different timbres. For example, in an orchestra, individual musicians or groups of musicians (e.g., first violins or second violins, or violins and cellos) performing at different frequency ranges, may be identified and distinguished from each other. Similarly, arrays of microphones or other audio detectors may be used to improve the resolution of the received audio input signal 104, to increase the number of audio tracks or instruments included in the audio input signal 104, or to provide other information for the audio input signal 104 (e.g., spatial information or depth).

In one embodiment, a composition is received in real time by a microphone or microphone array 102 and transduced to an analog electrical audio input signal 104 for receipt by the audio receiver unit 106. In other embodiments, the audio input signal 104 may comprise digital data, such as a recorded music file suitable for playback. If the audio input signal 104 is an analog signal, it is converted by the audio receiver unit 106 into a digital representation in preparation for digital signal processing by the signal processor unit 110, the note processor unit 130, and the score processor unit 150. Because the input signal is received in real time, there may be no way to predetermine the full length of the audio input signal 104. As such, the audio input signal 104 may be received and stored in predetermined intervals (e.g., an amount of elapsed time, number of digital samples, amounts of memory used, etc.), and may be processed accordingly. In another embodiment, a recorded sound clip is received by the audio receiver 106 and digitized, thereby having a fixed time duration.

In some embodiments, an array of microphones may be used for the detection of multiple instruments playing simultaneously. Each microphone in the array will be placed so that it is closer to a particular instrument than to any of the others, and therefore the intensity of the frequencies produced by that instrument will be higher for that microphone than for any of the others. Combining the information provided by the four detectors over the entire received sound, and using the signals recorded by all the microphones, may result in a digital abstract representation of the composition, which could mimic a MIDI representation of the recording with the information about the instruments in this case. The combination of information will include information relating to the sequence of pitches or notes, with time duration of frequencies (rhythm), overtone series associated with fundamental frequency (timbre: type of instrument or specific voice), and relative intensity (dynamics). Alternatively, a single microphone may be used to receive output from multiple instruments or other sources simultaneously.

In various embodiments, information extracted from the audio input signal 104 is processed to automatically generate a music score representation 170. Conventional software packages and libraries may be available for producing sheet music from the music score representation 170. Many such tools accept input in the form of a representation of the composition in a predetermined format such as the Musical Instrument Digital Interface (MIDI) or the like. Therefore, some embodiments of the system generate a music score representation 170 that is substantially in compliance with the MIDI standard to ensure compatibility with such conventional tools. Once the music score representation 170 is created, the potential applications are many-fold. In various embodiments, the score is either displayed on a device display, printed out, imported into music publishing programs, stored, or shared with others (e.g., for a collaborative music project).

It will be appreciated that many implementations of the system 100 are possible according to the invention. In some embodiments, the system 100 is implemented as a dedicated device. The device may include one or more internal microphones, configured to sense acoustic pressure and convert it into an audio input signal 104 for use by the system 100. Alternately, the device may include one or more audio input ports for interfacing with external microphones, media devices, data stores, or other audio sources. In certain of these embodiments, the device may be a handheld or portable device. In other embodiments, the system 100 may be implemented in a multi-purpose or general purpose device (e.g., as software modules stored on a computer-readable medium for execution by a computer). In certain of these embodiments, the audio source 102 may be a sound card, external microphone, or stored audio file. The audio input signal 104 is then generated and provided to the system 100.

Other embodiments of the system 100 may be implemented as a simplified or monaural version for operation as a music dictation device, which receives audio from users who play an instrument or sing a certain tune or melody or a part thereof into one microphone. In the single-microphone arrangement, the system 100 subsequently translates the recorded music from the one microphone into the corresponding music score. This may provide a musical equivalent to text-to-speech software that translates spoken words and sentences into computer-readable text. As a sound-to-notes conversion, the tune or melody will be registered as if one instrument where playing.

It will be appreciated that different implementations of the system 100 may also include different types of interfaces and functions relating to compatibility with users and other systems. For example, input ports may be provided for line-level inputs (e.g., from a stereo system or a guitar amplifier), microphone inputs, network inputs (e.g., from the Internet), or other digital audio components. Similarly, output ports may be provided for output to speakers, audio components, computers, and networks, etc. Further, in some implementations, the system 100 may provide user inputs (e.g., physical or virtual keypads, sliders, knobs, switches, etc.) and/or user outputs (e.g., displays, speakers, etc.). For example, interface capabilities may be provided to allow a user to listen to recordings or to data extracted from the recordings by the system 100.

Figure 1B:
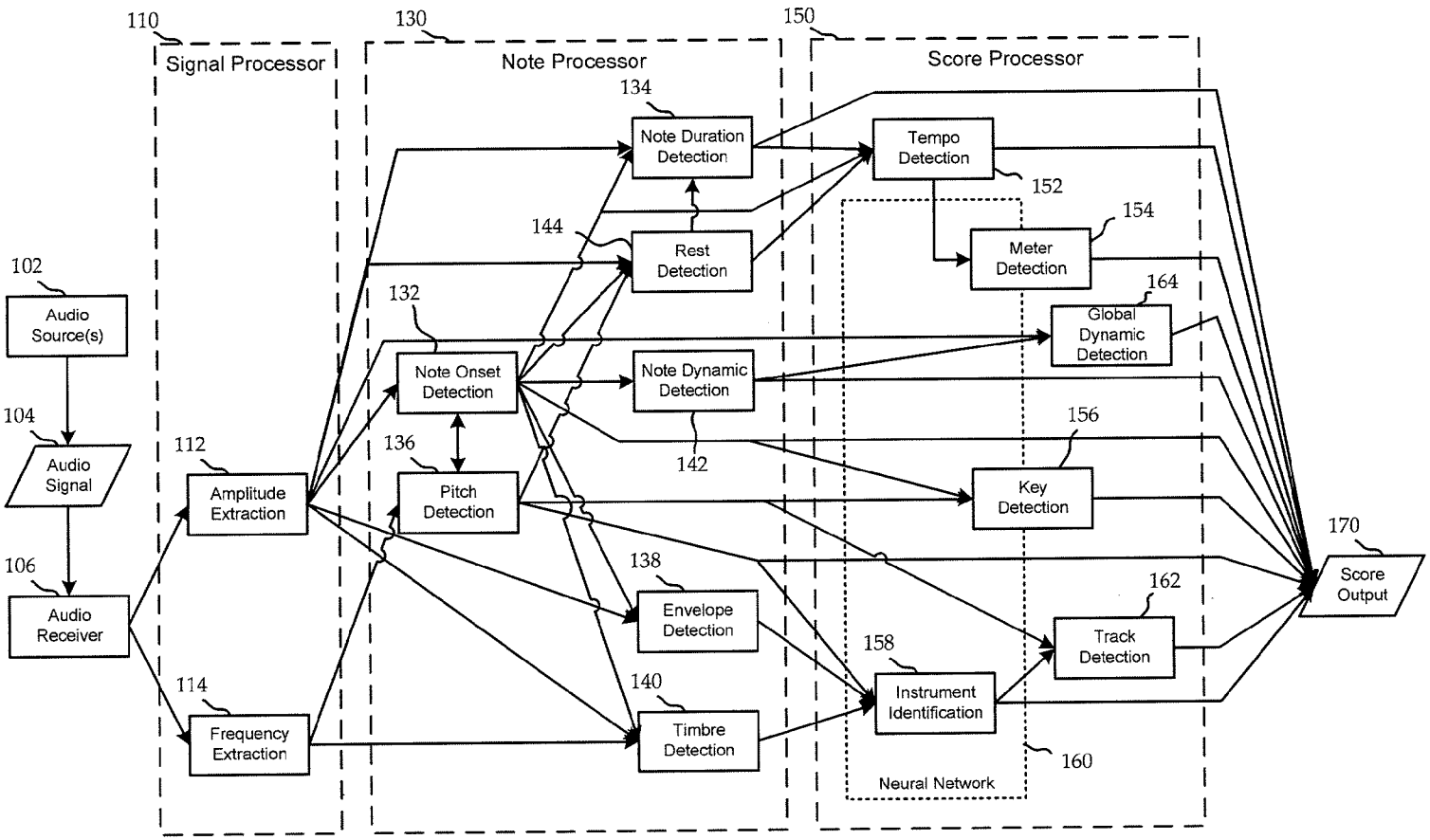
FIG. 1B provides a lower level simplified block diagram of a system like the one shown in FIG. 1 according to the present invention.

A lower-level block diagram of one embodiment of the system 100 is provided in FIG. 1B. One or more audio sources 102 may be used to generate an audio input signal. The audio source 102 may be anything capable of providing an audio input signal 104 to the audio receiver 106. In some embodiments, one or more microphones, transducers, and/or other sensors are used as audio sources 102. The microphones may convert pressure or electromagnetic waves from a live performance (or playback of a recorded performance) into an electrical signal for use as an audio input signal 104. For example, in a live audio performance, a microphone may be used to sense and convert audio from a singer, while electromagnetic "pick-ups" may be used to sense and convert audio from a guitar and a bass. In other embodiments, audio sources 102 may include analog or digital devices configured to provide an audio input signal 104 or an audio file from which an audio input signal 104 may be read. For example, digitized audio files may be stored on storage media in an audio format and provided by the storage media as an audio input signal 104 to the audio receiver 106.

It will be appreciated that, depending on the audio source 102, the audio input signal 104 may have different characteristics. The audio input signal 104 may be monophonic or polyphonic, may include multiple tracks of audio data, may include audio from many types of instruments, and may include certain file formatting, etc. Similarly, it will be appreciated that the audio receiver 106 may be anything capable of receiving the audio input signal 104. Further, the audio receiver 106 may include one or more ports, decoders, or other components necessary to interface with the audio sources 102, or receive or interpret the audio input signal 104.

The audio receiver 106 may provide additional functionality. In one embodiment, the audio receiver 106 converts analog audio input signals 104 to digital audio input signals 104. In another embodiment, the audio receiver 106 is configured to down-convert the audio input signal 104 to a lower sample rate to reduce the computational burden to the system 100. In one embodiment, the audio input signal 104 is down-sampled to around 8-9 kHz. This may provide higher frequency resolution of the audio input signal 104, and may reduce certain constraints on the design of the system 100 (e.g., filter specifications).

In yet another embodiment, the audio receiver 106 includes a threshold detection component, configured to begin receiving the audio input signal 104 (e.g., start recording) on detection of audio levels exceeding certain thresholds. For example, the threshold detection component may analyze the audio over a specified time period to detect whether the amplitude of the audio input signal 104 remains above a predetermined threshold for some predetermined amount of time. The threshold detection component may be further configured to stop receiving the audio input signal 104 (e.g., stop recording) when the amplitude of the audio input signal 104 drops below a predetermined threshold for a predetermined amount of time. In still another embodiment, the threshold detection component may be used to generate a flag for the system 100 representing the condition of the audio input signal 104 amplitude exceeding or falling below a threshold for an amount of time, rather than actually beginning or ending receipt of the audio input signal 104.

Signal and Note Processing

According to FIG. 1B, the audio receiver 106 passes the audio input signal 104 to the signal processor unit 110, which includes an amplitude extraction unit 112 and a frequency extraction unit 114. The amplitude extraction unit 112 is configured to extract amplitude-related information from the audio input signal 104. The frequency extraction unit 114 is configured to extract frequency-related information from the audio input signal 104.

In one embodiment, the frequency extraction unit 114 transforms the signal from the time domain into the frequency domain using a transform algorithm. For example, while in the time domain, the audio input signal 104 may be represented as changes in amplitude over time. However, after applying a Fast Fourier Transform (FFT) algorithm, the same audio input signal 104 may be represented as a graph of the amplitudes of each of its frequency components, (e.g., the relative strength or contribution of each frequency band in a range of frequencies, like an overtone series, over which the signal will be processed). For processing efficiency, in may be desirable to limit the algorithm to a certain frequency range. For example, the frequency range may only cover the audible spectrum (e.g., approximately 20 Hz to 20 kHz).

In various embodiments, the signal processor unit 110 may extract frequency-related information in other ways. For example, many transform algorithms output a signal in linear frequency "buckets" of fixed width. This may limit the potential frequency resolution or efficacy of the transform, especially given that the audio signal may be inherently logarithmic in nature (rather than linear). Many algorithms are known in the art for extracting frequency-related information from the audio input signal 104.

The amplitude-related information extracted by the amplitude extraction unit 112 and the frequency-related information extracted by the frequency extraction unit 114 may then be used by various components of the note processing unit 130. In some embodiments, the note processing unit 130 includes all or some of a note onset detector unit 132, a note duration detector unit 134, a pitch detector unit 136, a rest detector unit 144, an envelope detector unit 138, a timbre detector unit 140, and a note dynamic detector unit 142.

The note onset detector unit 132 is configured to detect the onset of a note. The onset (or beginning) of a note typically manifests in music as a change in pitch (e.g., a slur), a change in amplitude (e.g., an attach portion of an envelope), or some combination of a change in pitch and amplitude. As such, the note onset detector unit 132 may be configured to generate a note onset event whenever there is a certain type of change in frequency (or pitch) and/or amplitude, as described in more detail below with regard to FIGS. 4-5.

Musical notes may also be characterized by their duration (e.g., the amount of time a note lasts in seconds or number of samples). In some embodiments, the note processing unit 130 includes a note duration detector unit 134, configured to detect the duration of a note marked by a note onset event. The detection of note duration is discussed in greater detail below with regard to FIGS. 6 and 7.

It is worth noting that certain characteristics of music are psychoacoustic, rather than being purely physical attributes of a signal. For example, frequency is a physical property of a signal (e.g., representing the number of cycles-per-second traveled by a sinusoidal wave), but pitch is a more complex psychoacoustic phenomenon. One reason is that a note of a single pitch played by an instrument is usually made up of a number of frequencies, each at a different amplitude, known as the timbre. The brain may sense one of those frequencies (e.g., typically the fundamental frequency) as the "pitch," while sensing the other frequencies merely as adding "harmonic color" to the note. In some cases, the pitch of a note experienced by a listener may be a frequency that is mostly or completely absent from the signal.

In some embodiments, the note processing unit 130 includes a pitch detector unit 136, configured to detect the pitch of a note marked by a note onset event. In other embodiments, the pitch detector unit 136 is configured to track the pitch of the audio input signal 104, rather than (or in addition to) tracking the pitches of individual notes. It will be appreciated that the pitch detector unit 136 may be used by the note onset detector unit 132 in some cases to determine a change in pitch of the audio input signal 104 exceeding a threshold value.

Certain embodiments of the pitch detector unit 136 further process pitches to be more compatible with a final music score representation 170. Embodiments of pitch detection are described more fully with regard to FIG. 3.

Some embodiments of the note processing unit 130 include a rest detector unit 144 configured to detect the presence of rests within the audio input signal 104. One embodiment of the rest detector unit 144 uses amplitude-related information extracted by the amplitude extraction unit 112 and confidence information derived by the pitch detector unit 136. For example, amplitude-related information may reveal that the amplitude of the audio input signal 104 is relatively low (e.g., at or near the noise floor) over some window of time. Over the same window of time, the pitch detector unit 136 may determine that there is very low confidence of the presence of any particular pitch. Using this and other information, the rest detector unit 144 detects the presence of a rest, and a time location where the rest likely began. Embodiments of rest detection are described further with regard to FIGS. 9 and 10.

In some embodiments, the note processing unit 130 includes a timbre detector unit 140. Amplitude-related information extracted by the amplitude extraction unit 112 and frequency-related information extracted by the frequency extraction unit 114 may be used by the timbre detector unit 140 to detect timbre information for a portion of the audio input signal 104. The timbre information may reveal the harmonic composition of the portion of the audio signal 104. In some embodiments, the timbre detector unit 140 may detect timbre information relating to a particular note beginning at a note onset event.

In one embodiment of the timbre detector unit 140, the amplitude-related information and frequency-related information are convolved with a Gaussian filter to generate a filtered spectrum. The filtered spectrum may then be used to generate an envelope around a pitch detected by the pitch detector unit 136. This envelope may correspond to the timbre of the note at that pitch.

In some embodiments, the note processing unit 130 includes an envelope detector unit 138. Amplitude-related information extracted by the amplitude extraction unit 112 may be used by the envelope detector unit 138 to detect envelope information for a portion of the audio input signal 104. For example, hitting a key on a piano may cause a hammer to strike a set of strings, resulting in an audio signal with a large attack amplitude. This amplitude quickly goes through a decay, until it sustains at a somewhat steady-state amplitude where the strings resonate (of course, the amplitude may slowly lessen over this portion of the envelope as the energy in the strings is used up). Finally, when the piano key is released, a damper lands on the strings, causing the amplitude to quickly drop to zero. This type of envelope is typically referred to as an ADSR (attack, decay, sustain, release) envelope. The envelope detector unit 138 may be configured to detect some or all of the portions of an ADSR envelope, or any other type of useful envelope information.

In various embodiments, the note processing unit 130 also includes a note dynamic detector unit 142. In certain embodiments, the note dynamic detector unit 142 provides similar functionality to the envelope detector unit 138 for specific notes beginning at certain note onset events. In other embodiments, the note dynamic detector unit 142 is configured to detect note envelopes that are either abnormal with respect to a pattern of envelopes being detected by the envelope detector unit 138 or that fit a certain predefined pattern. For example, a staccato note may be characterized by sharp attack and short sustain portions of its ADSR envelope. In another example, an accented note may be characterized by an attack amplitude significantly greater than those of surrounding notes.

It will be appreciated that the note dynamic detector unit 142 and other note processing units may be used to identify multiple other attributes of a note which may be desirable as part of a musical score representation 170. For example, notes may be marked as slurred, as accented, as staccato, as grace notes, etc. Many other note characteristics may be extracted according to the invention.

Score Processing

Information relating to multiple notes or note onset events (including rests) may be used to generate other information. According to the embodiment of FIG. 1B, various components of the note processing unit 130 may be in operative communication with various components of the score processing unit 150. The score processing unit 150 may include all or some of a tempo detection unit 152, a meter detection unit 154, a key detection unit 156, an instrument identification unit 158, a track detection unit 162, and a global dynamic detection unit 164.

In some embodiments, the score processing unit 150 includes a tempo detection unit 152, configured to detect the tempo of the audio input signal 104 over a window of time. Typically, the tempo of a piece of music (e.g., the speed at which the music seems to pass psycho-acoustically) may be affected in part by the presence and duration of notes and rests. As such, certain embodiments of the tempo detection unit 152 use information from the note onset detector unit 132, the note duration detector unit 134, and the rest detector unit 144 to determine tempo. Other embodiments of the tempo detection unit 152 further use the determined tempo to assign note values (e.g., quarter note, eighth note, etc.) to notes and rests. Exemplary operations of the tempo detection unit 152 are discussed in further detail with regard to FIGS. 11-15.

Meter dictates how many beats are in each measure of music, and which note value it considered a single beat. For example, a meter of 4/4 represents that each measure has four beats (the numerator) and that a single beat is represented by a quarter note (the denominator). For this reason, meter may help determine note and bar line locations, and other information which may be needed to provide a useful musical score representation 170. In some embodiments, the score processing unit 150 includes a meter detection unit 154, configured to detect the meter of the audio input signal 104.

In some embodiments, simple meters are inferred from tempo information and note values extracted by the tempo detection unit 152 and from other information (e.g., note dynamic information extracted by the note dynamic detector unit 142). Usually, however, determining meter is a complex task involving complex pattern recognition.

For example, say the following sequence of note values is extracted from the audio input signal 104: quarter note, quarter note, eighth note, eighth note, eighth note, eighth note. This simple sequence could be represented as one measure of 4/4, two measures of 2/4, four measures of 1/4, one measure of 8/8, or many other meters. Assuming there was an accent (e.g., an increased attack amplitude) on the first quarter note and the first eighth note, this may make it more likely that the sequence is either two measures of 2/4, two measures of 4/8, or one measure of 4/4. Further, assuming that 4/8 is a very uncommon meter may be enough to eliminate that as a guess. Even further, knowledge that the genre of the audio input signal 104 is a folk song may make it more likely that 4/4 is the most likely meter candidate.

The example above illustrates the complexities involved even with a very simple note value sequence. Many note sequences are much more complex, involving many notes of different values, notes which span multiple measures, dotted and grace notes, syncopation, and other difficulties in interpreting meter. For this reason, traditional computing algorithms may have difficulty accurately determining meter. As such, various embodiments of the meter detection unit 154 use an artificial neural network (ANN) 0160, trained to detect those complex patterns. The ANN 0160 may be trained by providing the ANN 0160 with many samples of different meters and cost functions that refine with each sample. In some embodiments, the ANN 0160 is trained using a learning paradigm. The learning paradigm may include, for example, supervised learning, unsupervised learning, or reinforcement learning algorithms.

It will be appreciated that many useful types of information may be generated for use by the musical score representation 170 by using either or both of the tempo and meter information. For example, the information may allow a determination of where to bar notes together (e.g., as sets of eighth notes) rather than designating the notes individually with flags; when to split a note across two measures and tie it together; or when to designate sets of notes as triplets (or higher-order sets), grace notes, trills or mordents, glissandos; etc.

Another set of information which may be useful in generating a musical score representation 170 relates to the key of a section of the audio input signal 104. Key information may include, for example, an identified root pitch and an associated modality. For example, "A minor" represents that the root pitch of the key is "A" and the modality is minor. Each key is characterized by a key signature, which identifies the notes which are "in the key" (e.g., part of the diatonic scale associated with the key) and "outside the key" (e.g., accidentals in the paradigm of the key). "A minor," for example, contains no sharps or flats, while "D major" contains two sharps and no flats.

In some embodiments, the score processing unit 150 includes a key detection unit 156, configured to detect the key of the audio input signal 104. Some embodiments of the key detection unit 156 determine key based on comparing pitch sequences to a set of cost functions. The cost functions may, for example, seek to minimize the number of accidentals in a piece of music over a specified window of time. In other embodiments, the key detection unit 156 may use an artificial neural network to make or refine complex key determinations. In yet other embodiments, a sequence of key changes may be evaluated against cost functions to refine key determinations. In still other embodiments, key information derived by the key detection unit 156 may be used to attribute notes (or note onset events) with particular key pitch designations. For example, a "B" in F major may be designated as "B-natural." Of course, key information may be used to generate a key signature or other information for the musical score representation. In some embodiments, the key information may be further used to generate chord or other harmonic information. For example, guitar chords may be generated in tablature format, or jazz chords may be provided. Exemplary operations of the key detection unit 156 are discussed in further detail with regard to FIGS. 13-15.

In other embodiments, the score processing unit 150 also includes an instrument identification unit 158, configured to identify an instrument being played on the audio input signal 104. Often, an instrument is said to have a particular timbre. However, there may be differences in timbre on a single instrument depending on the note being played or the way the note is being played. For example, the timbre of every violin differs based, for example, on the materials used in its construction, the touch of the performer, the note being played (e.g., a note played on an open string has a different timbre from the same note played on a fingered string, and a note low in the violin's register has a different timbre from a note in the upper register), whether the note is bowed or plucked, etc. Still, however, there may be enough similarity between violin notes to identify them as violins, as opposed to another instrument.

Embodiments of the instrument identification unit 158 are configured to compare characteristics of single or multiple notes to determine the range of pitches apparently being played by an instrument of the audio input signal 104, the timbre being produced by the instrument at each of those pitches, and/or the amplitude envelope of notes being played on the instrument. In one embodiment, timbre differences are used to detect different instruments by comparing typical timbre signatures of instrument samples to detected timbres from the audio input signal 104. For example, even when playing the same note at the same volume for the same duration, a saxophone and a piano may sound very different because of their different timbres. Of course, as mentioned above, identifications based on timbre alone may be of limited accuracy.

In another embodiment, pitch ranges are used to detect different instruments. For example, a cello may typically play notes ranging from about two octaves below middle C to about one octave above middle C. A violin, however, may typically play notes ranging from just below middle C to about four octaves above middle C. Thus, even though a violin and cello may have similar timbres (they are both bowed string instruments), their pitch ranges may be different enough to be used for identification. Of course, errors may be likely, given that the ranges do overlap to some degree. Further, other instruments (e.g., the piano) have larger ranges, which may overlap with many instruments.

In still another embodiment, envelope detection is used to identify different instruments. For example, a note played on a hammered instrument (e.g., a piano) may sound different from the same note being played on a woodwind (e.g., a flute), reed (e.g., oboe), brass (e.g., trumpet), or string (e.g., violin) instrument. Each instrument, however, may be capable of producing many different types of envelope, depending on how a note is played. For example, a violin may be plucked or bowed, or a note may be played legato or staccato.

At least because of the difficulties mentioned above, accurate instrument identification may require detection of complex patterns, involving multiple characteristics of the audio input signal 104 possibly over multiple notes. As such, some embodiments of the instrument identification unit 158 utilize an artificial neural network trained to detect combinations of these complex patterns.

Some embodiments of the score processing unit 150 include a track detection unit 162, configured to identify an audio track from within the audio input signal 104. In some cases, the audio input signal 104 may be in a format which is already separated by track. For example, audio on some Digital Audio Tapes (DATs) may be stored as eight separate digital audio tracks. In these cases, the track detection unit 162 may be configured to simply identify the individual audio tracks.

In other cases, however, multiple tracks may be stored in a single audio input signal 104 and need to be identified by extracting certain data from the audio input signal. As such, some embodiments of the track detection unit 162 are configured to use information extracted from the audio input file 104 to identify separate audio tracks. For example, a performance may include five instruments playing simultaneously (e.g., a jazz quintet). It may be desirable to identify those separate instruments as separate tracks to be able to accurately represent the performance in a musical score representation 170.

Track detection may be accomplished in a number of different ways. In one embodiment, the track detection unit 162 uses pitch detection to determine whether different note sequences appear restricted to certain pitch ranges. In another embodiment, the track detection unit 162 uses instrument identification information from the instrument identification unit 158 to determine different tracks.

Many scores also contain information relating to global dynamics of a composition or performance. Global dynamics refer to dynamics which span more than one note, as opposed to the note dynamics described above. For example, an entire piece or section of a piece may be marked as forte (loud) or piano (soft). In another example, a sequence of notes may gradually swell in a crescendo. To generate this type of information, some embodiments of the score processing unit 150 include a global dynamic detection unit 164. Embodiments of the global dynamic detection unit 164 use amplitude information, in some cases including note dynamic information and/or envelope information, to detect global dynamics.

In certain embodiments, threshold values are predetermined or adaptively generated from the audio input signal 104 to aid in dynamics determinations. For example, the average volume of a rock performance may be considered forte. Amplitudes that exceed that average by some amount (e.g., by a threshold, a standard deviation, etc.) may be considered fortissimo, while amplitudes that drop below that average by some amount may be considered piano.

Certain embodiments may further consider the duration over which dynamic changes occur. For example, a piece that starts with two minutes of quiet notes and suddenly switches to a two-minute section of louder notes may be considered as having a piano section followed by a forte section. On the other hand, a quiet piece that swells over the course of a few notes, remains at that higher volume for a few more notes, and then returns to the original amplitude may be considered as having a crescendo followed by a decrescendo.

All the various types of information described above, and any other useful information, may be generated for use as a musical score representation 170. This musical score representation 170 may be saved or output. In certain embodiments, the musical score representation 170 is output to score generation software, which may transcribe the various types of information into a score format. The score format may be configured for viewing printing, electronically transmitting, etc.

It will be appreciated that the various units and components described above may be implemented in various ways without departing from the invention. For example, certain units may be components of other units, or may be implemented as additional functionality of another unit. Further, the units may be connected in many ways, and data may flow between them in many ways according to the invention. As such, FIG. 1B should be taken as illustrative, and should not be construed as limiting the scope of the invention.

Methods for Audio Processing

Figure 2:
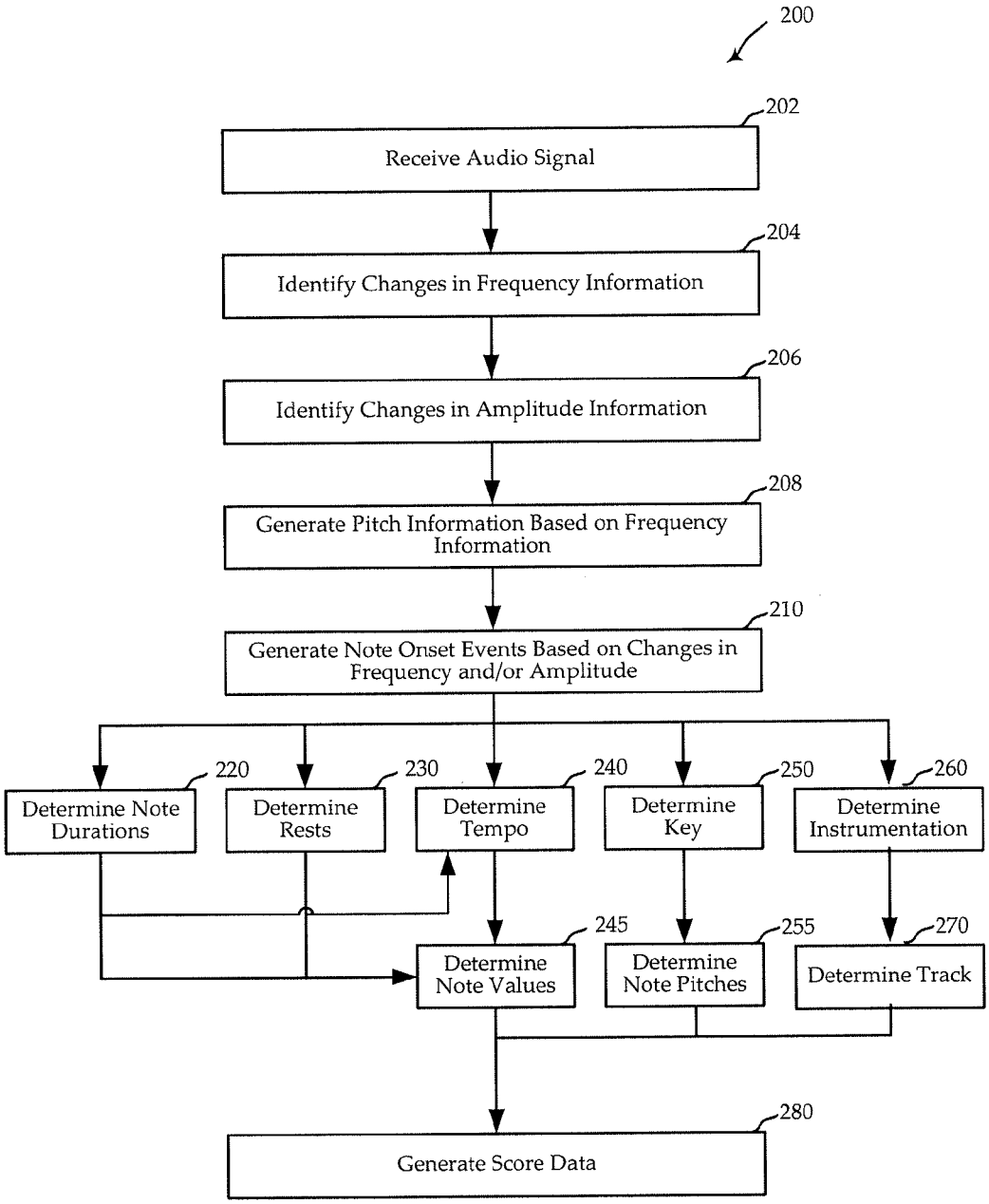
FIG. 2 provides a flow diagram of an exemplary method for converting audio signal data to score data according to embodiments of the invention.

FIG. 2 provides a flow diagram of an exemplary method for converting audio signal data to score data according to embodiments of the invention. The method 200 begins at block 202 by receiving an audio signal. In some embodiments, the audio signal may be preprocessed. For example, the audio signal may be converted from analog to digital, down-converted to a lower sample rate, transcoded for compatibility with certain encoders or decoders, parsed into monophonic audio tracks, or any other useful preprocessing.

At block 204, frequency information may be extracted from the audio signal and certain changes in frequency may be identified. At block 206, amplitude information may be extracted from the audio signal and certain changes in amplitude may be identified.

In some embodiments, pitch information is derived in block 208 from the frequency information extracted from the audio input signal in block 204. Exemplary embodiments of the pitch detection at block 208 are described more fully with respect to FIG. 3. Further, in some embodiments, the extracted and identified information relating to frequency and amplitude are used to generate note onset events at block 210. Exemplary embodiments of the note onset event generation at block 210 are described more fully with respect to FIGS. 4-5.

In some embodiments of the method 200, the frequency information extracted in block 204, the amplitude information extracted in block 206, and the note onset events generated in block 210 are used to extract and process other information from the audio signal. In certain embodiments, the information is used to determine note durations at block 220, to determine rests at block 230, to determine tempos over time windows at block 240, to determine keys over windows at block 250, and to determine instrumentation at block 260. In other embodiments, the note durations determined at block 220, rests determined at block 230, and tempos determined at block 240 are used to determine note values at block 245; the keys determined at block 250 are used to determine key pitch designations at block 255; and the instrumentation determined at block 260 is used to determine tracks at block 270. In various embodiments, the outputs of blocks 220-270 are configured to be used to generate musical score representation data at block 280. Exemplary methods for blocks 220-255 are described in greater detail with reference to FIGS. 6-15.

Pitch Detection

Figure 3:
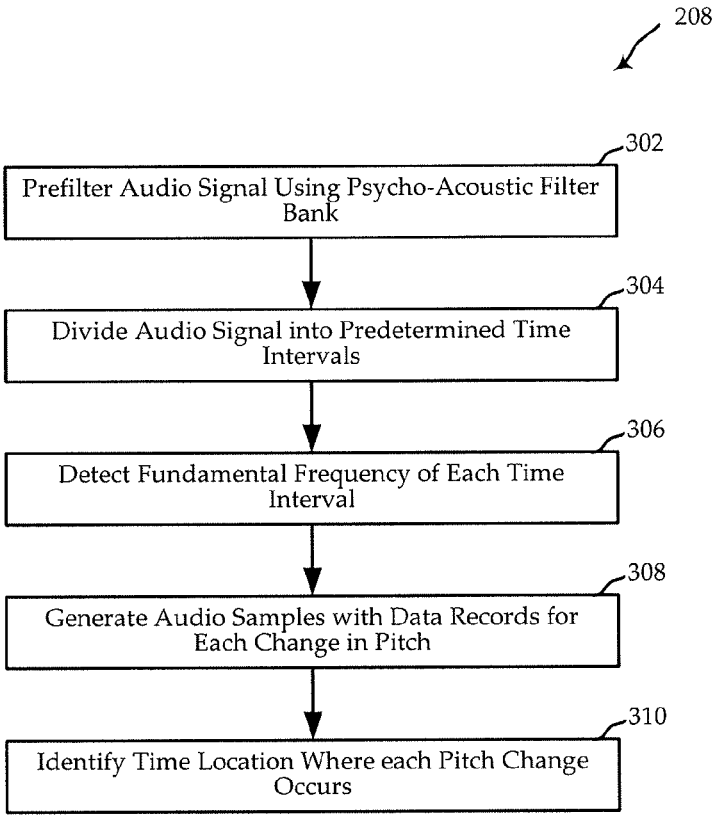
FIG. 3 provides a flow diagram of an exemplary method for the detection of pitch according to embodiments of the invention.

FIG. 3 provides a flow diagram of an exemplary method for the detection of pitch according to embodiments of the invention. Human perception of pitch is a psycho-acoustical phenomenon. Therefore, some embodiments of the method 208 begin at block 302 by prefiltering an audio input signal with a psycho-acoustic filter bank. The pre-filtering at block 302 may involve, for example, a weighting scale that simulates the hearing range of the human ear. Such weighting scales are known to those of skill in the art.

The method 208 may then continue at block 304 by dividing the audio input signal 104 into predetermined intervals. These intervals may be based on note onset events, sampling frequency of the signal, or any other useful interval. Depending on the interval type, embodiments of the method 208 may be configured, for example, to detect the pitch of a note marked by a note onset event or to track pitch changes in the audio input signal.

For each interval, the method 208 may detect a fundamental frequency at block 306. The fundamental frequency may be assigned as an interval's (or note's) "pitch." The fundamental frequency is often the lowest significant frequency, and the frequency with the greatest intensity, but not always.

The method 208 may further process the pitches to be more compatible with a final music score representation. For example, the music score representation may require a well-defined and finite set of pitches, represented by the notes that make up the score. Therefore embodiments of the method 208 may separate a frequency spectrum into bins associated with particular musical notes. In one embodiment, the method 208 calculates the energy in each of the bins and identifies the bin with the lowest significant energy as the fundamental pitch frequency. In another embodiment, the method 208 calculates an overtone series of the audio input signal based on the energy in each of the bins, and uses the overtone series to determine the fundamental pitch frequency.

In an exemplary embodiment, the method 208 employs a filter bank having a set of evenly-overlapping, two-octave-wide filters. Each filter bank is applied to a portion of the audio input signal. The output of each filter bank is analyzed to determine if the filtered portion of the audio input signal is sufficiently sinusoidal to contain essentially a single frequency. In this way, the method 208 may be able to extract the fundamental frequency of the audio input signal over a certain time interval as the pitch of the signal during that interval. In certain embodiments, the method 208 may be configured to derive the fundamental frequency of the audio input signal over an interval, even where the fundamental frequency is missing from the signal (e.g., by using geometric relationships among the overtone series of frequencies present in the audio input signal during that window).

In some embodiments, the method 208 uses a series of filter bank outputs to generate a set of audio samples at block 308. Each audio sample may have an associated data record, including, for example, information relating to estimated frequency, confidence values, time stamps, durations, and piano key indices. It will be appreciated that many ways are known in the art for extracting this data record information from the audio input signal. One exemplary approach is detailed in Lawrence Saul, Daniel Lee, Charles Isbell, and Yaun LeCun, "Real time voice processing with audiovisual feedback: toward autonomous agents with perfect pitch," *Advances in Neural Information Processing Systems* (*NIPS*) 15, pp. 1205-1212 (2002), which is incorporated herein by reference for all purposes. The data record information for the audio samples may be buffered and sorted to determine what pitch would be heard by a listener.

Some embodiments of the method 208 continue at block 310 by determining where the pitch change occurred. For example, if pitches are separated into musical bins (e.g., scale tones), it may be desirable to determine where the pitch of the audio signal crossed from one bin into the next. Otherwise, vibrato, tremolo, and other musical effects may be misidentified as pitch changes. Identifying the beginning of a pitch change may also be useful in determining note onset events, as described below.

Note Onset Detection

Many elements of a musical composition are characterized, at least in part, by the beginnings of notes. On a score, for example, it may be necessary to know where notes begin to determine the proper temporal placement of notes in measures, the tempo and meter of a composition, and other important information. Some expressive musical performances involve note changes that involve subjective determinations of where notes begin (e.g., because of slow slurs from one note to another). Score generation, however, may force a more objective determination of where notes begin and end. These note beginnings are referred to herein as note onset events.

Figure 4A:
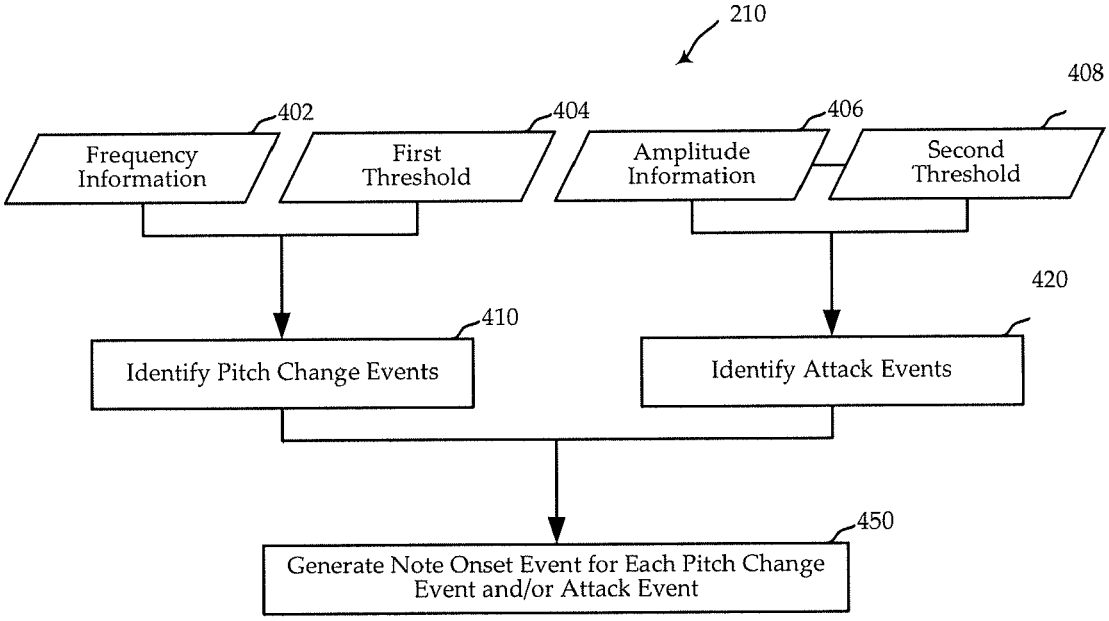
FIG. 4A provides a flow diagram of an exemplary method for the generation of note onset events according to embodiments of the invention.

FIG. 4A provides a flow diagram of an exemplary method for the generation of note onset events according to embodiments of the invention. The method 210 begins at block 410 by identifying pitch change events. In some embodiments, the pitch change events are determined at block 410 based on changes in frequency information 402 extracted from the audio signal (e.g., as in block 204 of FIG. 2) in excess of a first threshold value 404. In some embodiments of the method 210, the pitch change event is identified using the method described with reference to block 208 of FIG. 2.

By identifying pitch change events at block 410, the method 210 may detect note onset events at block 450 whenever there is a sufficient change in pitch. In this way, even a slow slur from one pitch to another, with no detectable change in amplitude, would generate a note onset event at block 450. Using pitch detection alone, however, would fail to detect a repeated pitch. If a performer were to play the same pitch multiple times in a row, there would be no change in pitch to signal a pitch change event at block 410, and no generation of a note onset event at block 450.

Therefore, embodiments of the method 210 also identify attack events at block 420. In some embodiments, the attack events are determined at block 420 based on changes in amplitude information 406 extracted from the audio signal (e.g., as in block 206 of FIG. 2) in excess of a second threshold value 408. An attack event may be a change in the amplitude of the audio signal of the character to signal the onset of a note. By identifying attack events at block 420, the method 210 may detect note onset events at block 450 whenever there is a characteristic change in amplitude. In this way, even a repeated pitch would generate a note onset event at block 450.

Figure 4B:
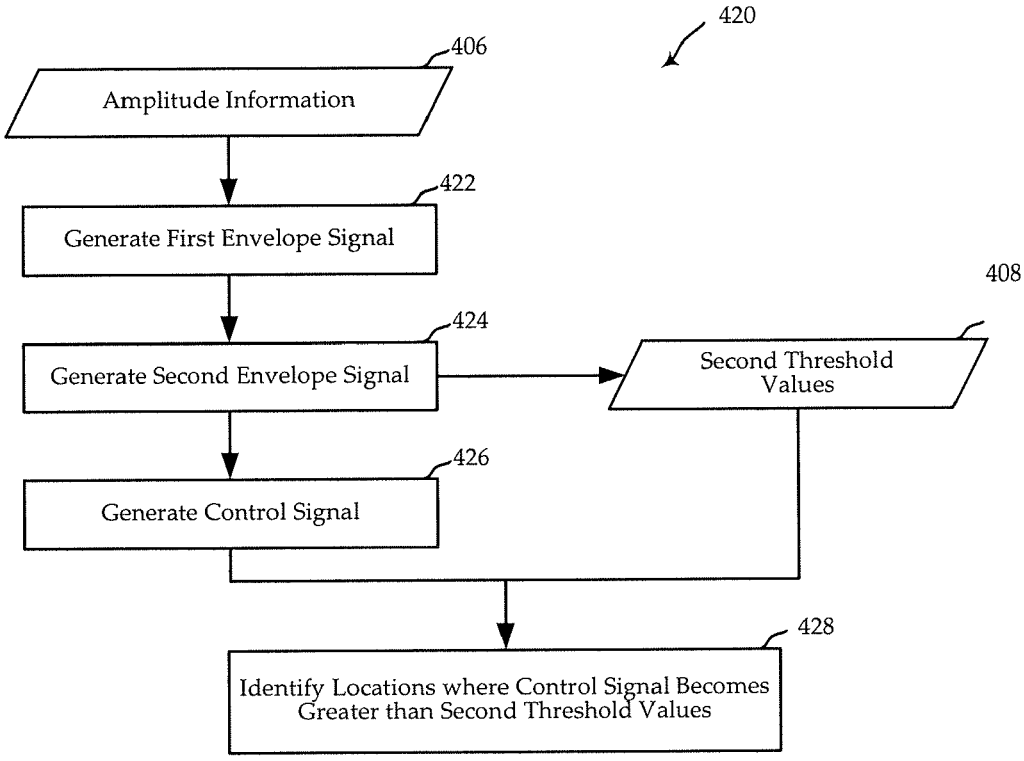
FIG. 4B provides a flow diagram of an exemplary method for determining an attack event according to embodiments of the invention.

It will be appreciated that many ways are possible for detecting an attack event. FIG. 4B provides a flow diagram of an exemplary method for determining an attack event according to embodiments of the invention. The method 420 begins by using amplitude information 406 extracted from the audio signal to generate a first envelope signal at block 422. The first envelope signal may represent a "fast envelope" that tracks envelope-level changes in amplitude of the audio signal.

In some embodiments, the first envelope signal is generated at block 422 by first rectifying and filtering the amplitude information 406. In one embodiment, an absolute value is taken of the signal amplitude, which is then rectified using a full-wave rectifier to generate a rectified version of the audio signal. The first envelope signal may then be generated by filtering the rectified signal using a low-pass filter. This may yield a first envelope signal that substantially holds the overall form of the rectified audio signal.

A second envelope signal may be generated at block 424. The second envelope signal may represent a "slow envelope" that approximates the average power of the envelope of the audio signal. In some embodiments, the second envelope signal may be generated at block 424 by calculating the average power of the first envelope signal either continuously or over predetermined time intervals (e.g., by integrating the signal). In certain embodiments, the second threshold values 408 may be derived from the values of the second envelope signal at given time locations.

At block 426, a control signal is generated. The control signal may represent more significant directional changes in the first envelope signal. In one embodiment, the control signal is generated at block 426 by: (1) finding the amplitude of the first envelope signal at a first time location; (2) continuing at that amplitude until a second time location (e.g., the first and second time locations are spaced by a predetermined amount of time); and (3) setting the second time location as the new time location and repeating the process (i.e., moving to the new amplitude at the second time location and remaining there for the predetermined amount of time.

The method 420 then identifies any location where the control signal becomes greater than (e.g., crosses in a positive direction) the second envelope signal as an attack event at block 428. In this way, attack events may only be identified where a significant change in envelope occurs. An exemplary illustration of this method 420 is shown in FIG. 5.

Figure 5:
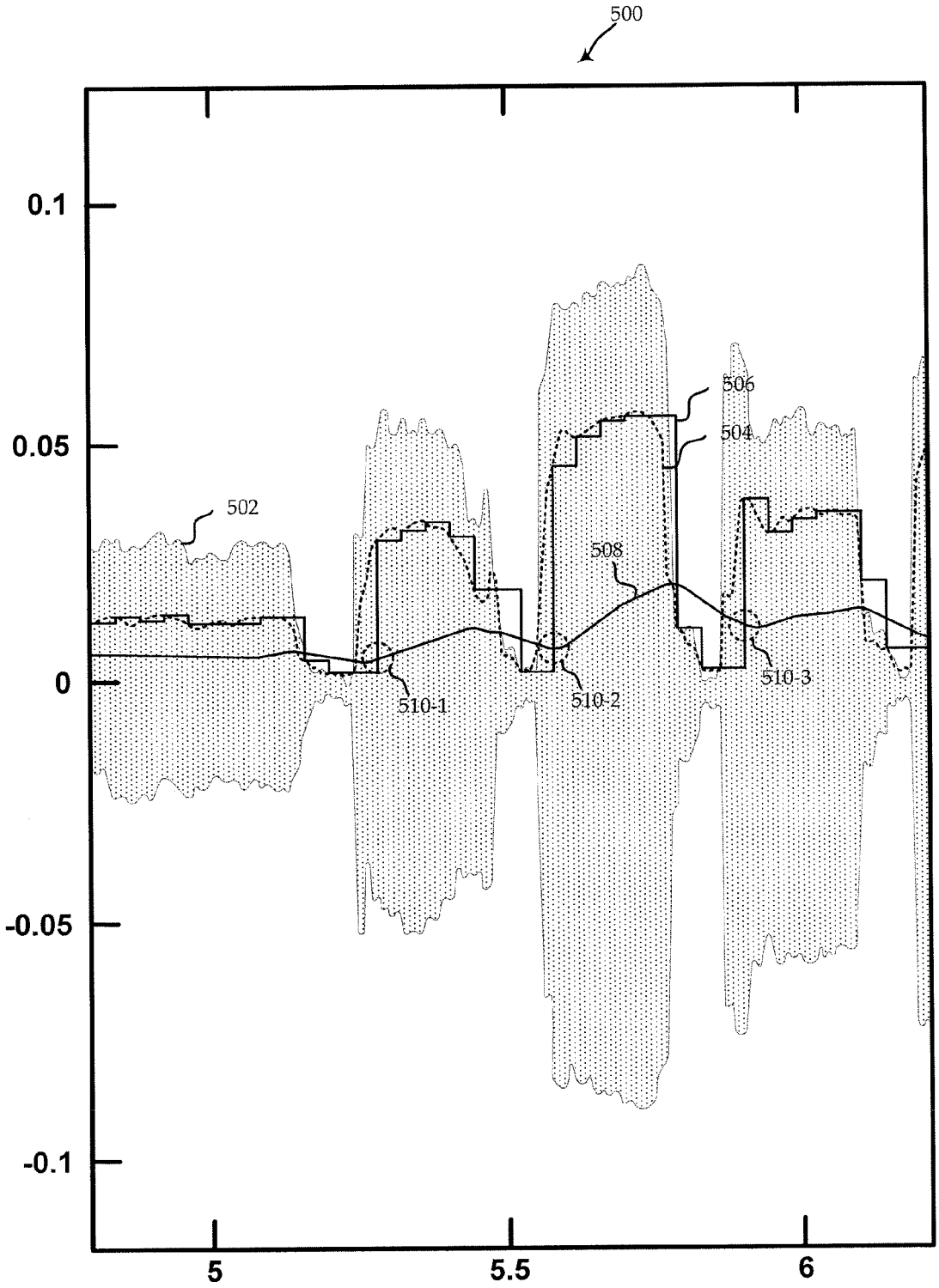
FIG. 5 provides an illustration of an audio signal with various envelopes for use in note onset event generation according to embodiments of the invention.

FIG. 5 provides an illustration of an audio signal with various envelopes for use in note onset event generation according to embodiments of the invention. The illustrative graph 500 plots amplitude versus time for the audio input signal 502, the first envelope signal 504, the second envelope signal 506, and the control signal 508. The graph also illustrates attack event locations 510 where the amplitude of the control signal 508 becomes greater than the amplitude of the second envelope signal 506.

Note Duration Detection

Figure 6:
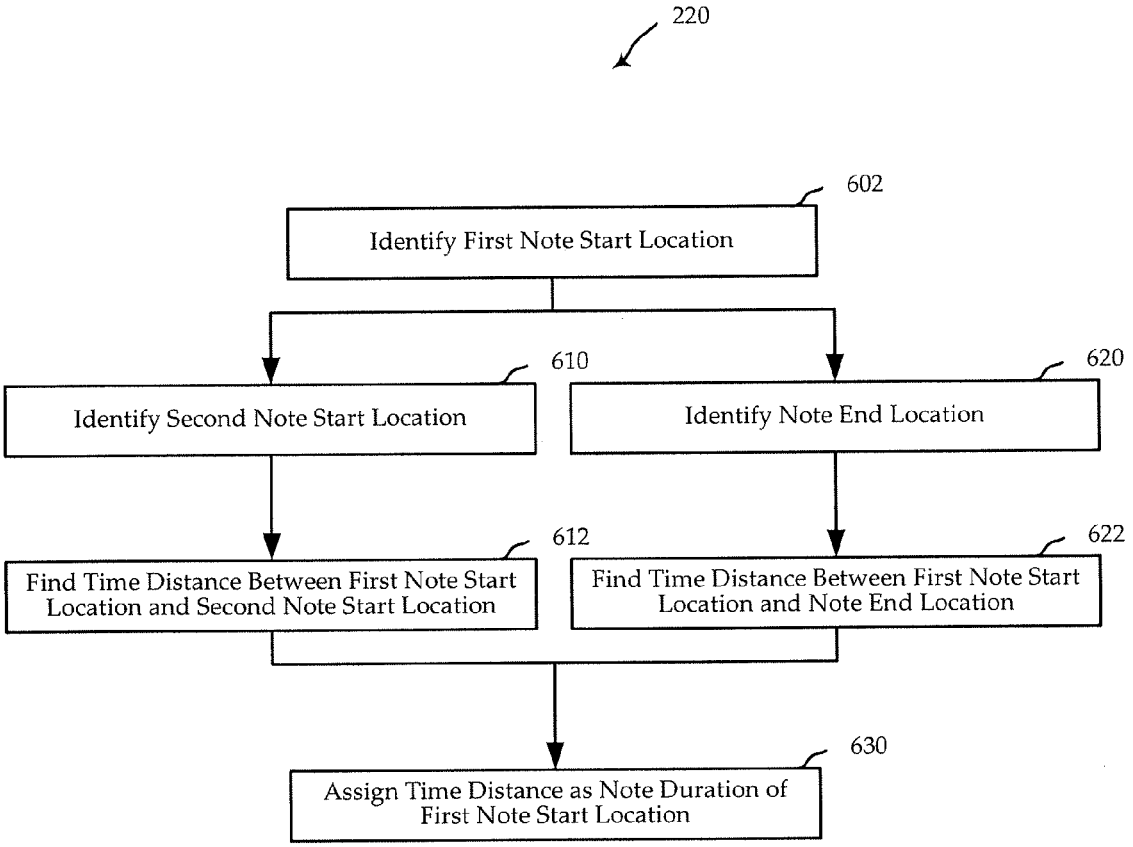
FIG. 6 provides a flow diagram of an exemplary method for the detection of note duration according to embodiments of the invention.

Once the beginning of a note is identified by generating a note onset event, it may be useful to determine where the note ends (or the duration of the note). FIG. 6 provides a flow diagram of an exemplary method for the detection of note duration according to embodiments of the invention. The method 220 begins by identifying a first note start location at block 602. In some embodiments, the first note start location is identified at block 602 by generating (or identifying) a note onset event, as described more fully with regard to FIGS. 4-5.

In some embodiments, the method 220 continues by identifying a second note start location at block 610. This second note start location may be identified at block 610 in the same or a different way from the identification of the first note start location identified in block 602. In block 612, the duration of a note associated with the first note start location is calculated by determining the time interval between the first note start location to the second note start location. This determination in block 612 may yield the duration of a note as the elapsed time from the start of one note to the start of the next note.

In some cases, however, a note may end some time before the beginning of the next note. For example, a note may be followed by a rest, or the note may be played in a staccato fashion. In these cases, the determination in block 612 would yield a note duration that exceeds the actual duration of the note. It is worth noting that this potential limitation may be corrected in many ways by detecting the note end location.

Some embodiments of the method 220 identify a note end location in block 620. In block 622, the duration of a note associated with the first note start location may then be calculated by determining the time interval between the first note start location and the note end location. This determination in block 622 may yield the duration of a note as the elapsed time from the start of one note to the end of that note. Once the note duration has been determined either at block 612 or at block 622, the note duration may be assigned to the note (or note onset event) beginning at the first time location at block 630.

It will be appreciated that many ways are possible for identifying a note end location in block 620 according to the invention. In one embodiment, the note end location is detected in block 620 by determining if any rests are present between the notes, and to subtract the duration of the rests from the note duration (the detection of rests and rest durations is discussed below). In another embodiment, the envelope of the note is analyzed to determine whether the note was being played in such a way as to change its duration (e.g., in a staccato fashion).

In still another embodiment of block 620, note end location is detected similarly to the detection of the note start location in the method 420 of FIG. 4B. Using amplitude information extracted from the audio input signal, a first envelope signal, a second envelope signal, and a control signal may all be generated. Note end locations may be determined by identifying locations where the amplitude of the control signal becomes less than the amplitude of the second envelope signal.

It is worth noting that in polyphonic music, there may be cases where notes overlap. As such, there may be conditions where the end of a first note comes after the beginning of a second note, but before the end of the second note. Simply detecting the first note end after a note beginning, therefore, may not yield the appropriate end location for that note. As such, it may be necessary to extract monophonic tracks (as described below) to more accurately identify note durations.

Figure 7:
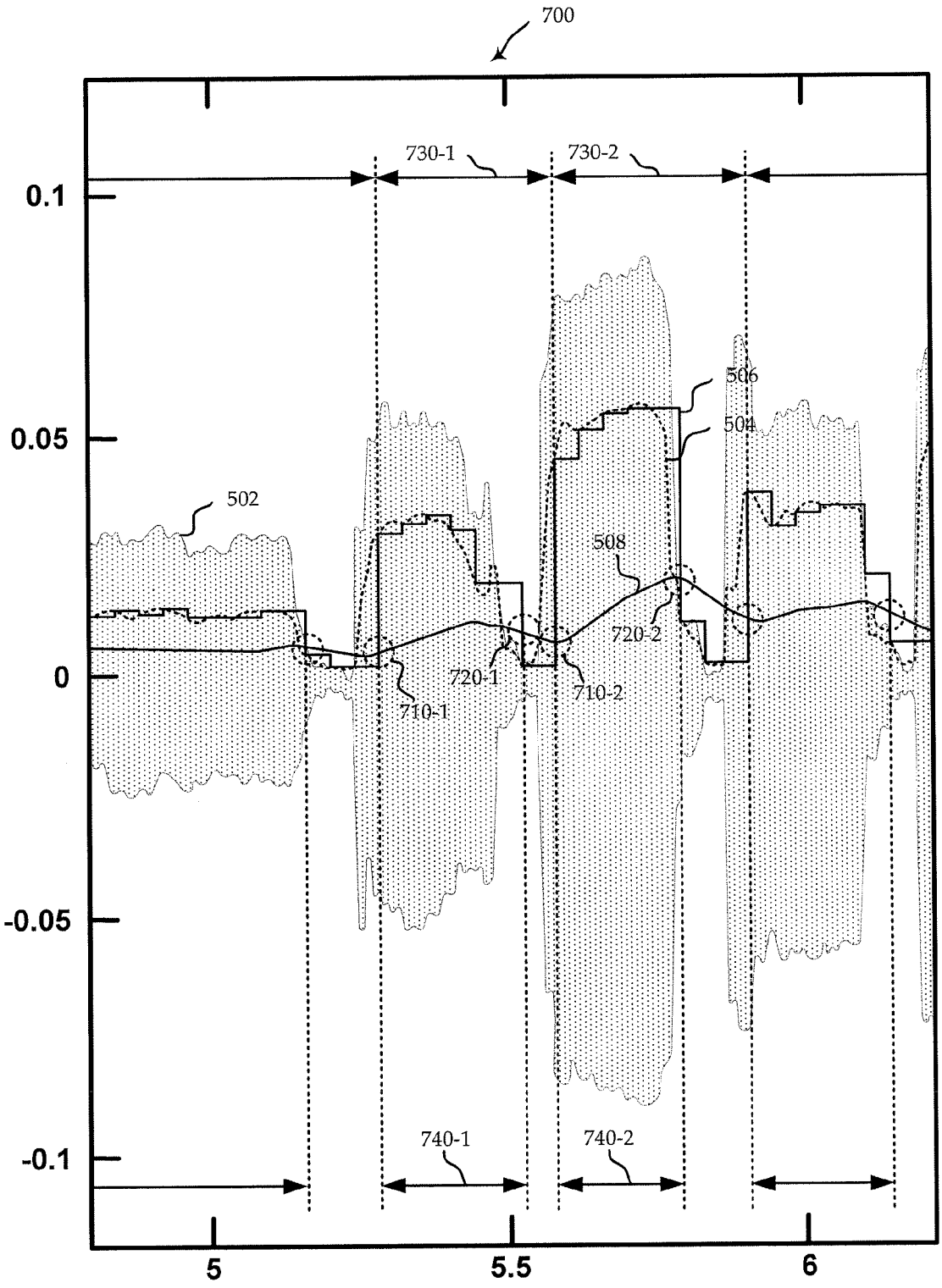
FIG. 7 provides an illustration of an audio signal with various envelopes for use in note duration detection according to embodiments of the invention.

FIG. 7 provides an illustration of an audio signal with various envelopes for use in note duration detection according to embodiments of the invention. The illustrative graph 700 plots amplitude versus time for the audio input signal 502, the first envelope signal 504, the second envelope signal 506, and the control signal 508. The graph also illustrates note start locations 710 where the amplitude of the control signal 508 becomes greater than the amplitude of the second envelope signal 506, and note end locations 720 where the amplitude of the control signal 508 becomes less than the amplitude of the second envelope signal 506.

The graph 700 further illustrates two embodiments of note duration detection. In one embodiment, a first note duration 730-1 is determined by finding the elapsed time between a first note start location 710-1 and a second note start location 710-2. In another embodiment, a second note duration 740-1 is determined by finding the elapsed time between a first note start location 710-1 and a first note end location 720-1.

Rest Detection

Figure 8:
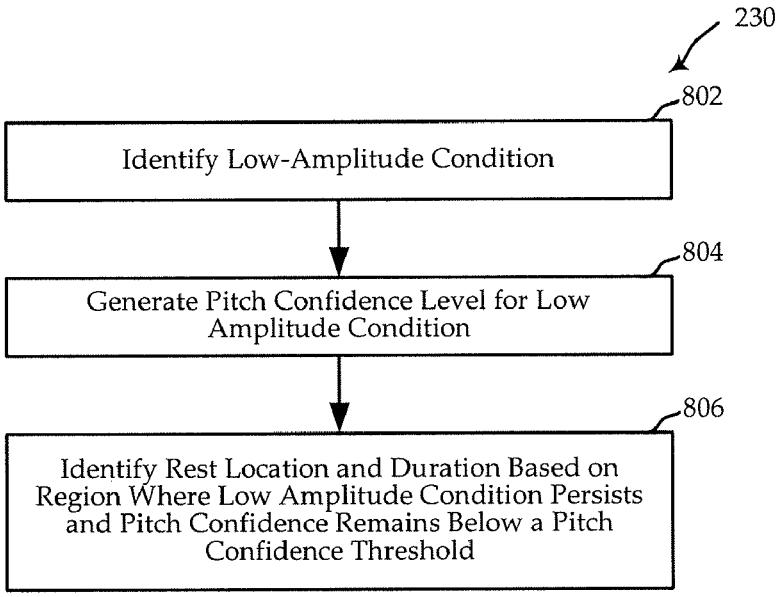
FIG. 8 provides a flow diagram of an exemplary method for the detection of rests according to embodiments of the invention.

FIG. 8 provides a flow diagram of an exemplary method for the detection of rests according to embodiments of the invention. The method 230 begins by identifying a low amplitude condition in the input audio signal in block 802. It will be appreciated that many ways are possible for identifying a low amplitude condition according to the invention. In one embodiment, a noise threshold level is set at some amplitude above the noise floor for the input audio signal. A low amplitude condition may then by identified as a region of the input audio signal during which the amplitude of the signal remains below the noise threshold for some predetermined amount of time.

In block 804, regions where there is a low amplitude condition are analyzed for pitch confidence. The pitch confidence may identify the likelihood that a pitch (e.g., as part of an intended note) is present in the region. It will be appreciated that pitch confidence may be determined in many ways, for example as described with reference to pitch detection above.

Where the pitch confidence is below some pitch confidence threshold in a low amplitude region of the signal, it may be highly unlikely that any note is present. In certain embodiments, regions where no note is present are determined to include a rest in block 806. Of course, as mentioned above, other musical conditions may result in the appearance of a rest (e.g., a staccato note). As such, in some embodiments, other information (e.g., envelope information, instrument identification, etc.) may be used to refine the determination of whether a rest is present.

Tempo Detection

Once the locations of notes and rests are known, it may be desirable to determine tempo. Tempo matches the adaptive musical concept of beat to the standard physical concept of time, essentially providing a measure of the speed of a musical composition (e.g., how quickly the composition should be performed). Often, tempo is represented in number of beats per minute, where a beat is represented by some note value. For example, a musical score may represent a single beat as a quarter note, and the tempo may be eighty-four beats per minute (bpm). In this example, performing the composition at the designated tempo would mean playing the composition at a speed where eighty-four quarter notes-worth of music are performed every minute.

Figure 9:
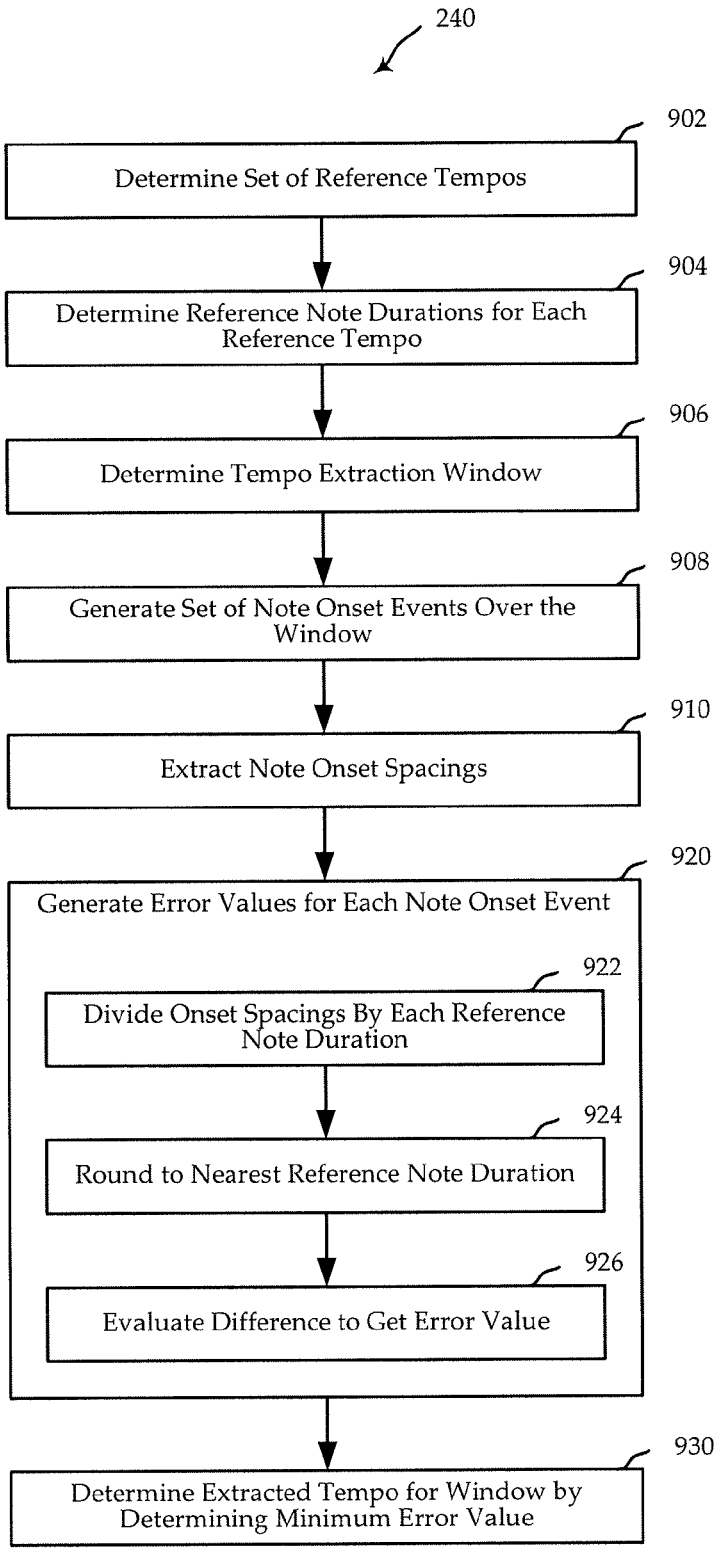
FIG. 9 provides a flow diagram of an exemplary method for the detection of tempo according to embodiments of the invention.

FIG. 9 provides a flow diagram of an exemplary method for the detection of tempo according to embodiments of the invention. The method 240 begins by determining a set of reference tempos at block 902. In one embodiment, standard metronome tempos may be used. For example, a typical metronome may be configured to keep time for tempos ganging from 40 bpm to 208 bpm, in intervals of 4 bpm (i.e., 40 bpm, 44 bpm, 48 bpm, . . . 208 bpm). In other embodiments, other values and intervals between values may be used. For example, the set of reference tempos may include all tempos ranging from 10 bpm to 300 bpm in ¼-bpm intervals (i.e., 10 bpm, 10.25 bpm, 10.5 bpm, . . . 300 bpm).

The method 240 may then determine reference note durations for each reference tempo. The reference note durations may represent how long a certain note value lasts at a given reference tempo. In some embodiments, the reference note durations may be measured in time (e.g., seconds), while in other embodiments, the reference note durations may be measured in number of samples. For example, assuming a quarter note represents a single beat, the quarter note at 84 bpm will last approximately 0.7143 seconds (i.e., 60 seconds per minute divided by 84 beats per minute). Similarly, assuming a sample rate of 44,100 samples per second, the quarter note at 84 bpm will last 31,500 samples (i.e., 44,100 samples per second times 60 seconds per minute divided by 84 beats per minute). In certain embodiments, a number of note values may be evaluated at each reference tempo to generate the set of reference note durations. For example, sixteenth notes, eighth notes, quarter notes, and half notes may all be evaluated. In this way, idealized note values may be created for each reference tempo.

In some embodiments of the method 240, a tempo extraction window may be determined at block 906. The tempo extraction window may be a predetermined or adaptive window of time spanning some contiguous portion of the audio input signal. Preferably, the tempo extraction window is wide enough to cover a large number of note onset events. As such, certain embodiments of block 906 adapt the width of the tempo extraction window to cover a predetermined number of note onset events.

At block 908, the set of note onset events occurring during the tempo extraction window is identified or generated. In certain embodiments, the set of rest start locations occurring during the tempo extraction window is also identified or generated. At block 910, note onset spacings are extracted. Note onset spacings represent the amount of time elapsed between the onset of each note or rest, and the onset of the subsequent note or rest. As discussed above, the note onset spacings may be the same or different from the note durations.

The method 240 continues at block 920 by determining error values for each extracted note onset spacing relative to the idealized note values determined in block 904. In one embodiment, each note onset spacing is divided by each reference note duration at block 922. The result may then be used to determine the closest reference note duration (or multiple of a reference note duration) to the note onset spacing at block 924.

For example, a note onset spacing may be 35,650 samples. Dividing the note onset spacing by the various reference note durations and taking the absolute value of the difference may generate various results, each result representing an error value. For instance, the error value of the note onset spacing compared to a reference quarter note at 72 bpm (36,750 samples) may be approximately 0.03, while the error value of the note onset spacing compared to a reference eighth note at 76 bpm (17,408 samples) may be approximately 1.05. The minimum error value may then be used to determine the closest reference note duration (e.g., a quarter note at 72 bpm, in this exemplary case).

In some embodiments, one or more error values are generated across multiple note onset events. In one embodiment, the error values of all note onset events in the tempo extraction window are mathematically combined before a minimum composite error value is determined. For example, the error values of the various note onset events may be summed, averaged, or otherwise mathematically combined.

Once the error values are determined at block 920, the minimum error value is determined at block 930. The reference tempo associated with the minimum error value may then be used as the extracted tempo. In the example above, the lowest error value resulted from the reference note duration of a quarter note at 72 bpm. As such, 72 bpm may be determined as the extracted tempo over a given window.

Figure 10:
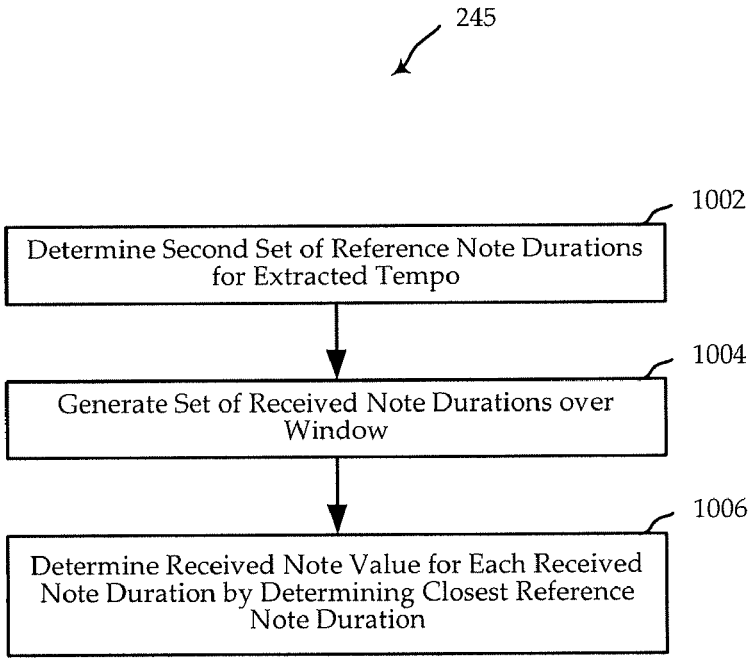
FIG. 10 provides a flow diagram of an exemplary method for the determination of note value according to embodiments of the invention.

Once the tempo is determined, it may be desirable to assign note values for each note or rest identified in the audio input signal (or at least in a window of the signal). FIG. 10 provides a flow diagram of an exemplary method for the determination of note value according to embodiments of the invention. The method 245 begins at block 1002 by determining a second set of reference note durations for the tempo extracted in block 930 of FIG. 9. In some embodiments, the second set of reference note durations is the same as the first set of reference note durations. In these embodiments, it will be appreciated that the second set may be simply extracted as a subset of the first set of reference note durations. In other embodiments, the first set of reference note durations includes only a subset of the possible note values, while the second set of reference note durations includes a more complete set of possible note durations for the extracted tempo.

In block 1004, the method 245 may generate or identify the received note durations for the note onset events in the window, as extracted from the audio input signal. The received note durations may represent the actual durations of the notes and rests occurring during the window, as opposed to the idealized durations represented by the second set of reference note durations. At block 1006, the received note durations are compared with the reference note durations to determine the closest reference note duration (or multiple of a reference note duration).

The closest reference note duration may then be assigned to the note or rest as its note value. In one example, a received note duration is determined to be approximately 1.01 reference quarter notes, and may be assigned a note value of one quarter note. In another example, a received note duration is determined to be approximately 1.51 reference eighth notes, and is assigned a note value of one dotted-eighth note (or an eighth note tied to a sixteenth note).

Figure 12:
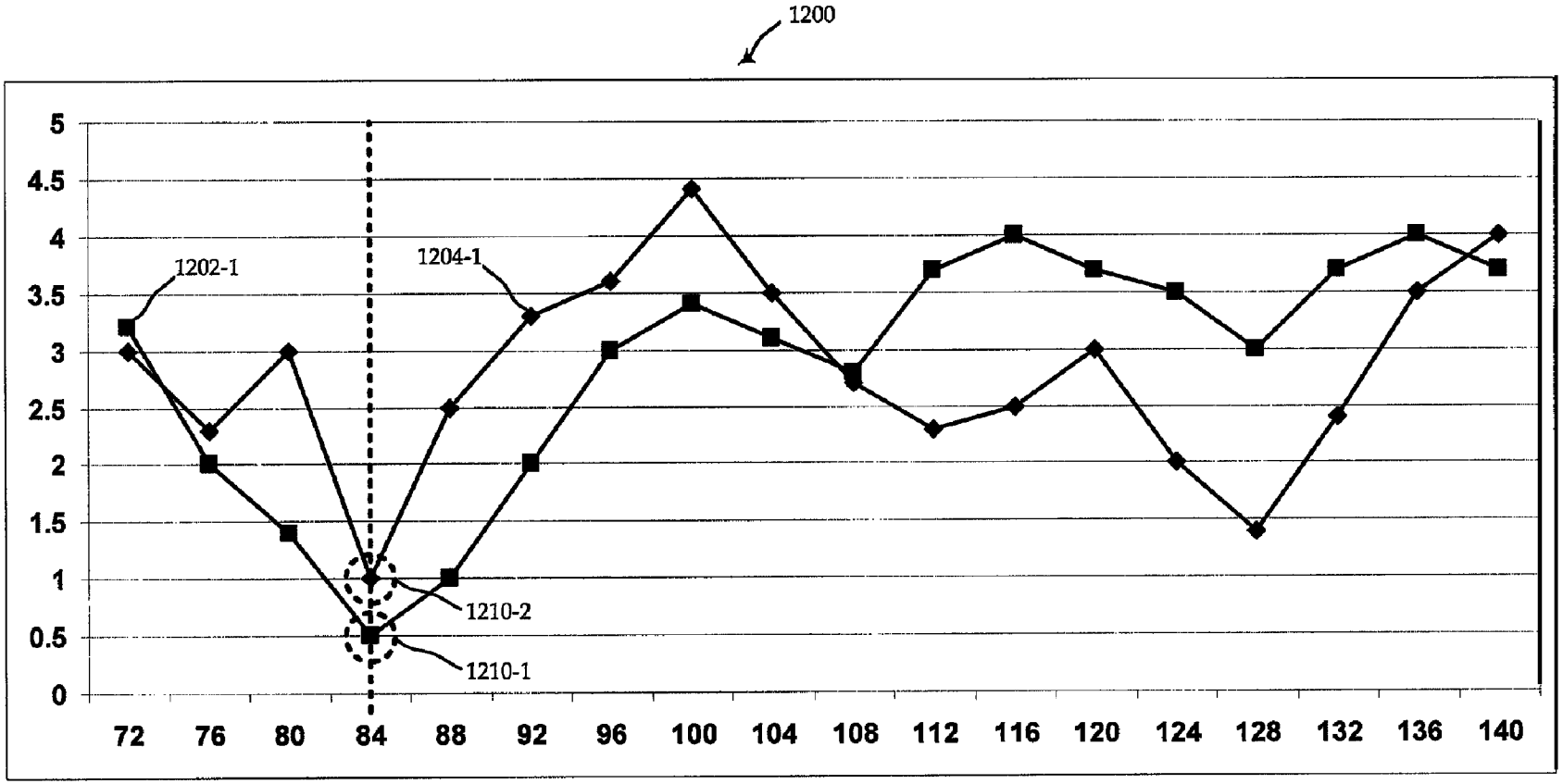
FIG. 12 provides additional exemplary data illustrating the exemplary tempo detection method shown in FIG. 11.

FIG. 12 provides a graph of exemplary data illustrating this exemplary tempo detection method. The graph 1200 plots composite error value against tempo in beats per minute. The box points 1202 represent error values from using reference quarter notes, and the diamond points 1204 represent error values from using reference eighth notes. For example, the first box point 1202-1 on the graph 1200 illustrates that for a set of note onset spacings compared to a reference quarter note at 72 bpm, an error value of approximately 3.3 was generated.

The graph 1200 illustrates that the minimum error for the quarter note reference durations 1210-1 and the minimum error for the eighth note reference durations 1210-2 were both generated at 84 bpm. This may indicate that over the window of the audio input signal, the extracted tempo is 84 bpm.

Figure 11:
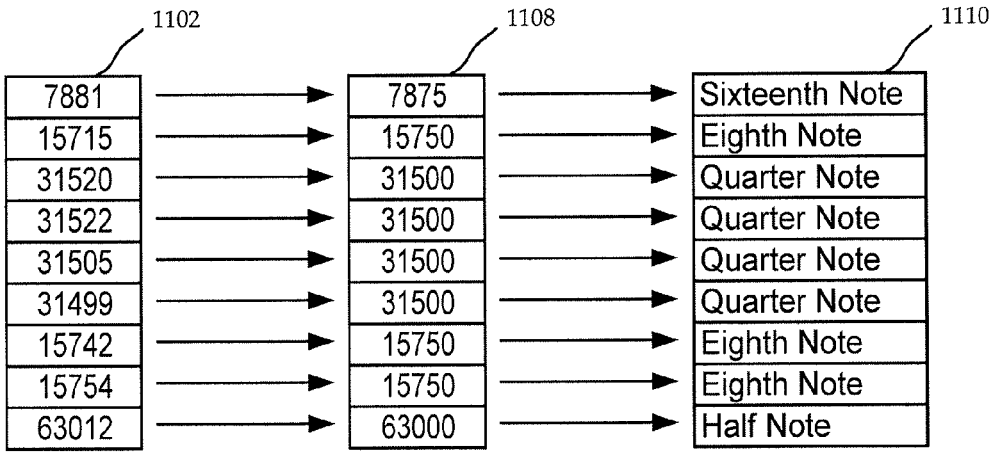
FIG. 11 provides a graph of exemplary data illustrating this exemplary tempo detection method.

FIG. 11 provides additional exemplary data illustrating the exemplary tempo detection method shown in FIG. 12. A portion of the set of note onset spacings 1102 is shown, measured in number of samples ranging from 7,881 to 63,012 samples. The note onset spacings 1102 are be evaluated against a set of reference note durations 1104. The reference note durations 1104, as shown, include durations in both seconds and samples (assuming a sample rate of 44,100 samples per second) of four note values over eight reference tempos. As shown in FIG. 12, the extracted tempo is determined to be 84 bpm. The reference note durations relating to a reference tempo of 84 bpm 1106 are extracted, and compared to the note onset spacings. The closest reference note durations 1108 are identified. These durations may then be used to assign note values 1110 to each note onset spacing (or the duration of each note beginning at each note onset spacing).

Key Detection

Determining the key of a portion of the audio input signal may be important to generating useful score output. For example, determining the key may provide the key signature for the portion of the composition and may identify where notes should be identified with accidentals. However, determining key may be difficult for a number of reasons.

One reason is that compositions often move between keys (e.g., by modulation). For example, a rock song may have verses in the key of G major, modulate to the key of C major for each chorus, and modulate further to D minor during the bridge. Another reason is that compositions often contain a number of accidentals (notes that are not "in the key"). For example, a song in C major (which contains no sharps or flats) may use a sharp or flat to add color or tension to a note phrase. Still another reason is that compositions often have transition periods between keys, where the phrases exhibit a sort of hybrid key. In these hybrid states, it may be difficult to determine when the key changes, or which portions of the music belong to which key. For example, during a transition from C major to F major, a song may repeatedly use a B-flat. This would show up as an accidental in the key of C major, but not in the key of F. Therefore, it may be desirable to determine where the key change occurs, so the musical score representation 170 does not either incorrectly reflect accidentals or repeatedly flip-flop between keys. Yet another reason determining key may be difficult is that multiple keys may have identical key signatures. For example, there are no sharps or flats in any of C major, A minor, or D dorian.

Figure 13:
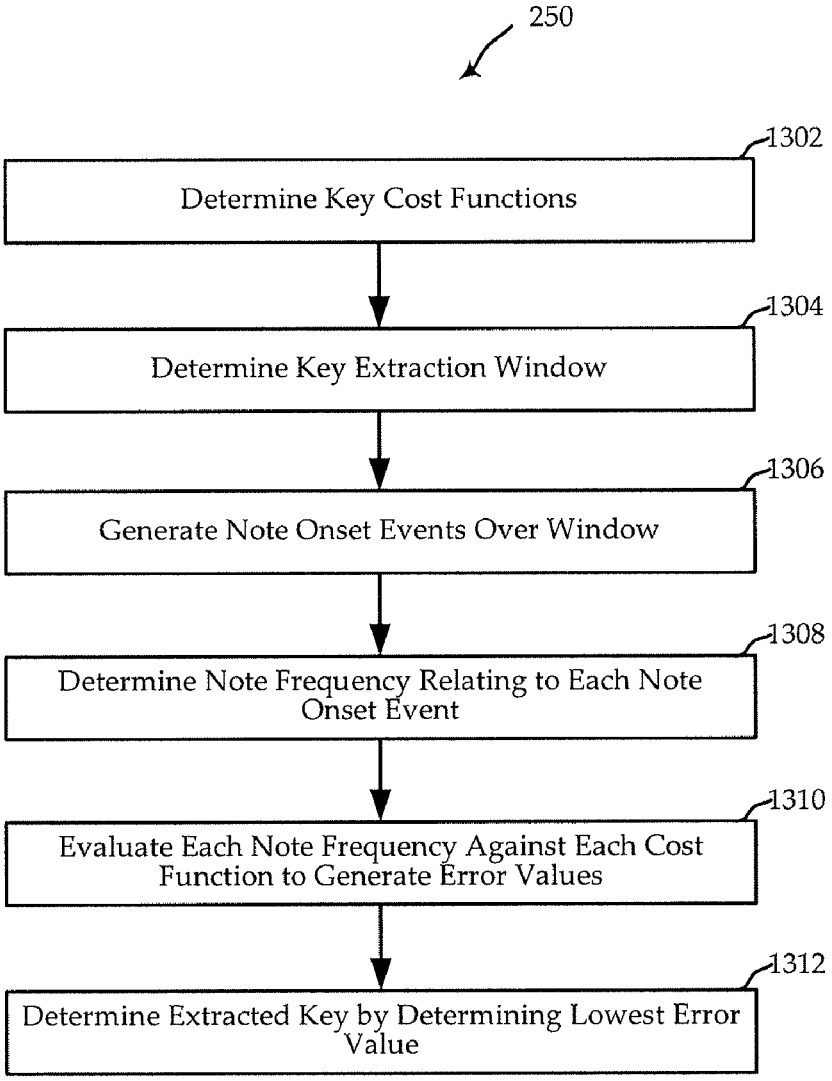
FIG. 13 provides a flow diagram of an exemplary method for the detection of key according to embodiments of the invention.

FIG. 13 provides a flow diagram of an exemplary method for the detection of key according to embodiments of the invention. The method 250 begins by determining a set of key cost functions at block 1302. The cost functions may, for example, seek to minimize the number of accidentals in a piece of music over a specified window of time.

FIGS. 14A and 14B provide illustrations of two exemplary key cost functions use in key detection according to embodiments of the invention. In FIG. 14A, the key cost function 1400 is based on a series of diatonic scales in various keys. A value of "1" is given for all notes in the diatonic scale for that key, and a value of "0" is given for all notes not in the diatonic scale for that key. For example, the key of C major contains the following diatonic scale: C-D-E-F-G-A-B. Thus, the first row 1402-1 of the cost function 1400 shows "1"s for only those notes.

In FIG. 14B, the key cost function 1450 is also based on a series of diatonic scales in various keys. Unlike the cost function 1400 in FIG. 14A, the cost function 1450 in FIG. 14B assigns a value of "2" for all first, third, and fifth scale tones in a given key. Still, a value of "1" is given for all other notes in the diatonic scale for that key, and a value of "0" is given for all notes not in the diatonic scale for that key. For example, the key of C major contains the diatonic scale, C-D-E-F-G-A-B, in which the first scale tone is C, the third scale tone is E, and the fifth scale tone is G. Thus, the first row 1452-1 of the cost function 1450 shows 2-0-1-0-2-1-0-2-0-1-0-1.

This cost function 1450 may be useful for a number of reasons. One reason is that in many musical genres (e.g., folk, rock, classical, etc.) the first, third, and fifth scale tones tend to have psycho-acoustical significance in creating a sense of a certain key in a listener. As such, weighting the cost function more heavily towards those notes may improve the accuracy of the key determination in certain cases. Another reason to use this cost function 1450 may be to distinguish keys with similar key signatures. For example, C major, D dorian, G mixolydian, A minor, and other keys all contain no sharps or flats. However, each of these keys has a different first, third, and/or fifth scale tone from each of the others. Thus, an equal weighting of all notes in the scale may reveal little difference between the presence of these keys (even though there may be significant psycho-acoustic differences), but an adjusted weighting may improve the key determination.

It will be appreciated that other adjustments may be made to the cost functions for different reasons. In one embodiment, the cost function may be weighted differently to reflect a genre of the audio input signal (e.g., received from a user, from header information in the audio file, etc.). For example, a blues cost function may weigh notes more heavily according to the pentatonic, rather than diatonic, scales of a key.

Returning to FIG. 13, a key extraction window may be determined at block 1304. The key extraction window may be a predetermined or adaptive window of time spanning some contiguous portion of the audio input signal. Preferably, the key extraction window is wide enough to cover a large number of note onset events. As such, certain embodiments of block 1304 adapt the width of the tempo extraction window to cover a predetermined number of note onset events.

At block 1306, the set of note onset events occurring during the key extraction window is identified or generated. The note pitch for each note onset event is then determined at block 1308. The note pitch may be determined in any effective way at block 1308, including by the pitch determination methods described above. It will be appreciated that, because a note onset event represents a time location, there cannot technically be a pitch at that time location (pitch determination requires some time duration). As such, pitch at a note onset generally refers to the pitch associated with the note duration following the note onset event.

At block 1310, each note pitch may be evaluated against each cost function to generate a set of error values. For example, say the sequence of note pitches for a window of the audio input signal is as follows: C-C-G-G-A-A-G-F-F-E-E-D-D-C. Evaluating this sequence against the first row 1402-1 of the cost function 1400 in FIG. 14A may yield an error value of 1+1+1+1+1+1+1+1+1+1+1+1+1+1=14. Evaluating the sequence against the third row 1402-2 of the cost function 1400 in FIG. 14A may yield an error value of 0+0+1+1+1+1+1+0+0+1+1+1+1+0=9. Importantly, evaluating the sequence against the fourth row 1402-3 of the cost function 1400 in FIG. 14A may yield the same error value of 14 as when the first row 1402-1 was used. Using this data, it appears relatively unlikely that the pitch sequence is in the key of D major, but impossible to determine whether C major or A minor (which share the same key signature) is a more likely candidate.

Using the cost function 1450 in FIG. 14B yields different results. Evaluating the sequence against the first row 1452-1 may yield an error value of 2+2+2+2+1+1+2+1+1+2+2+1+1+2=22. Evaluating the sequence against the third row 1452-2 may yield an error value of 0+0+1+1+2+2+1+0+0+2+2+1+1+0=13. Importantly, evaluating the sequence against the fourth row 1452-3 may yield an error value of 2+2+1+1+2+2+1+1+1+2+2+1+1+2=21, one less than the error value of 22 achieved when the first row 1452-1 was used. Using this data, it still appears relatively unlikely that the pitch sequence is in the key of D major, but now it appears slightly more likely that the sequence is in C major than in A minor.

It will be appreciated that the cost functions discussed above (e.g., 1400 and 1450) yield higher results when the received notes are more likely in a given key due to the fact that non-zero values are assigned to notes within the key. Other embodiments, however, may assign "0"s to pitch that are the "most in the key" according to the criteria of the cost function. Using these other embodiments of cost functions may yield higher numbers for keys which match less, thereby generating what may be a more intuitive error value (i.e., higher error value represents a worse match).

In block 1312, the various error values for the different key cost functions are compared to yield the key with the best match to the note pitch sequence. As mentioned above, in some embodiments, this may involve finding the highest result (i.e., the best match), while in other embodiments, this may involve finding the lowest result (i.e., least matching error), depending on the formulation of the cost function.

It is worth noting that other methods of key determination are possible according to the invention. In some embodiments, an artificial neural network may be used to make or refine complex key determinations. In other embodiments, a sequence of key changes may be evaluated against cost functions to refine key determinations. For example, method 250 may detect a series of keys in the audio input signal of the pattern C major-F major-G major-C major. However, confidence in the detection of F major may be limited, due to the detection of a number of B-naturals (the sharp-4 of F—an unlikely note in most musical genres). Given that the key identified as F major precedes a section in G major of a song that begins and ends in C major, the presence of even occasional B-naturals may indicate that the key determination should be revised to a more fitting choice (e.g., D dorian or even D minor).

Figure 15:
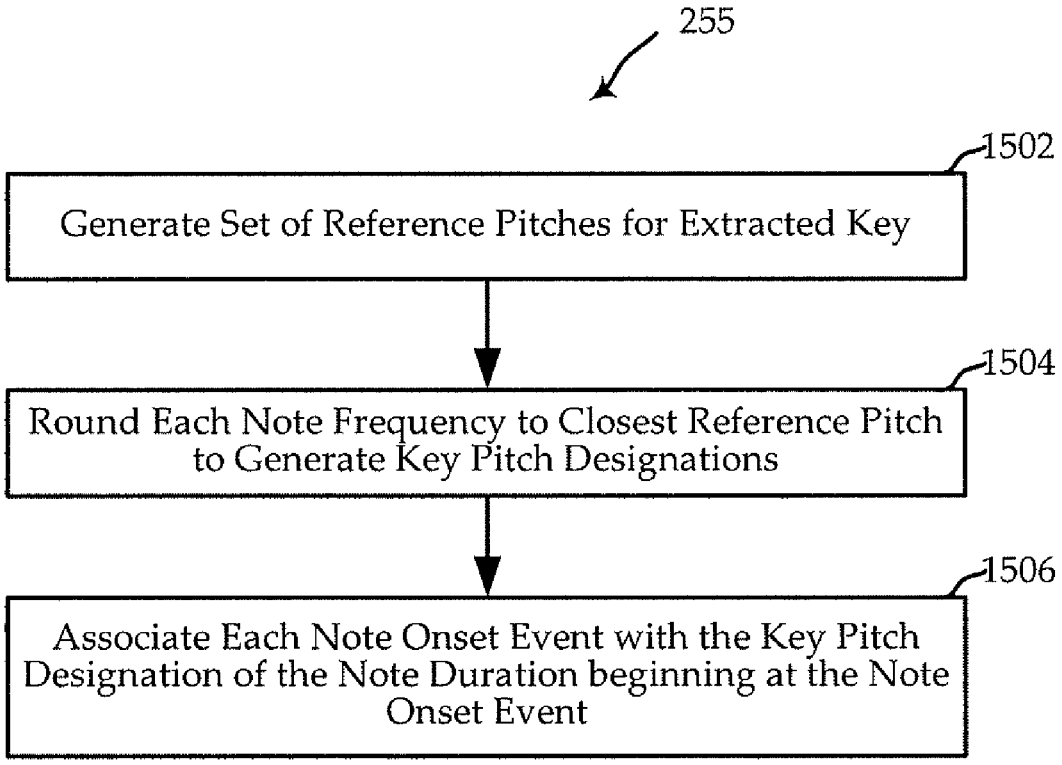
FIG. 15 provides a flow diagram of an exemplary method for the determination of key pitch designation according to embodiments of the invention.

Once the key has been determined, it may be desirable to fit key pitch designations to notes at each note onset event (at least for those onset events occurring within the key extraction window. FIG. 15 provides a flow diagram of an exemplary method for the determination of key pitch designation according to embodiments of the invention. The method 255 begins by generating a set of reference pitches for the extracted key at block 1502.

It is worth noting that the possible pitches may be the same for all keys (e.g., especially considering modern tuning standards). For example, all twelve chromatic notes in every octave of a piano may be played in any key. The difference may be how those pitches are represented on a score (e.g., different keys may assign different accidentals to the same note pitch). For example, the key pitches for the "white keys" on a piano in C major may be designated as C, D, E, F, G, A, and B. The same set of key pitches in D major may be designated as C-natural, D, E, F-natural, G, A, and B.

At block 1504, the closest reference pitch to each extracted note pitch is determined and used to generate the key pitch determination for that note. The key pitch determination may then be assigned to the note (or note onset event) at block 1506.

Exemplary Hardware System

The systems and methods described above may be implemented in a number of ways. One such implementation includes various electronic components. For example, units of the system in FIG. 1B may, individually or collectively, be implemented with one or more Application Specific Integrated Circuits (ASICs) adapted to perform some or all of the applicable functions in hardware. Alternatively, the functions may be performed by one or more other processing units (or cores), on one or more integrated circuits. In other embodiments, other types of integrated circuits may be used (e.g., Structured/Platform ASICs, Field Programmable Gate Arrays (FPGAs), and other Semi-Custom ICs), which may be programmed in any manner known in the art. The functions of each unit may also be implemented, in whole or in part, with instructions embodied in a memory, formatted to be executed by one or more general or application-specific processors.

Figure 16:
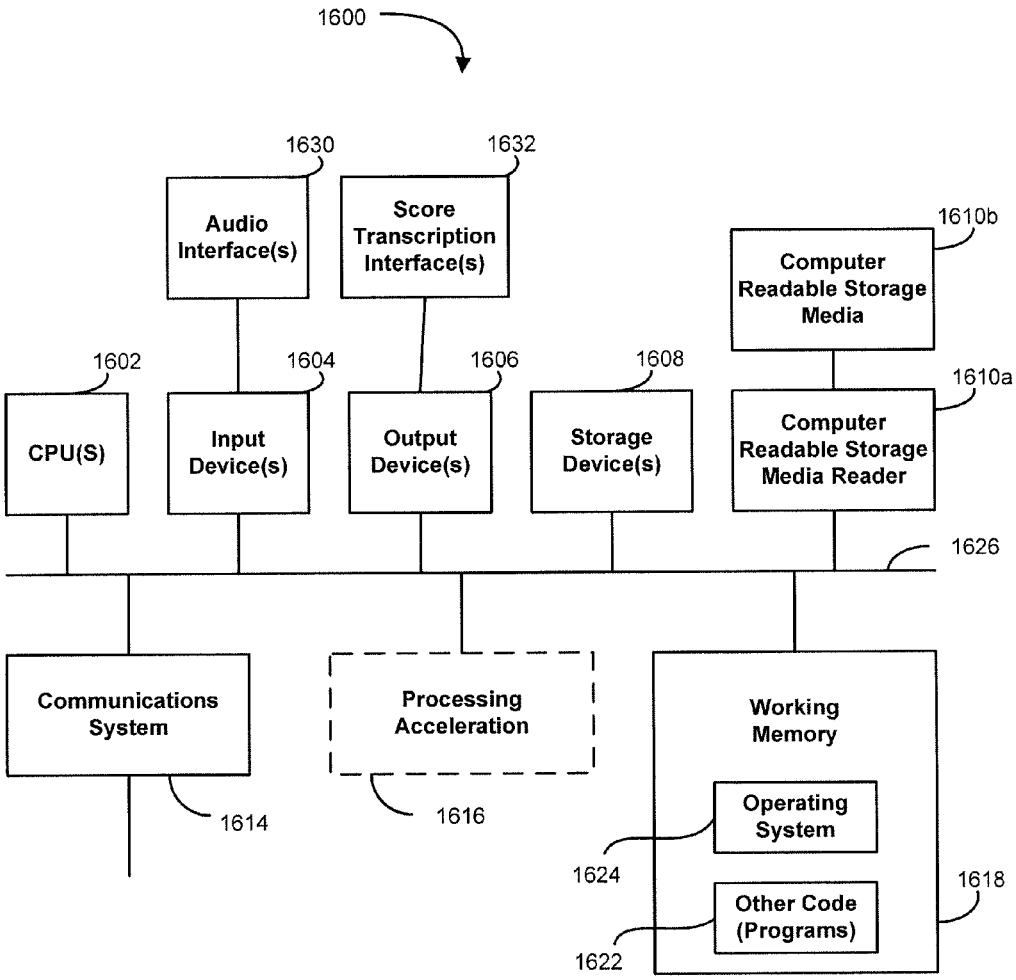
FIG. 16 provides a block diagram of a computational system 1600 for implementing certain embodiments of the invention.

FIG. 16 provides a block diagram of a computational system 1600 for implementing certain embodiments of the invention. In one embodiment, the computation system 1600 may function as the system 100 shown in FIG. 1A. It should be noted that FIG. 16 is meant only to provide a generalized illustration of various components, any or all of which may be utilized as appropriate. FIG. 16, therefore, broadly illustrates how individual system elements may be implemented in a relatively separated or relatively more integrated manner.

The computer system 1600 is shown comprising hardware elements that can be electrically coupled via a bus 1626 (or may otherwise be in communication, as appropriate). The hardware elements can include one or more processors 1602, including without limitation one or more general-purpose processors and/or one or more special-purpose processors (such as digital signal processing chips, graphics acceleration chips, and/or the like); one or more input devices 1604, which can include, without limitation, a mouse, a keyboard, and/or the like; and one or more output devices 1606, which can include without limitation a display device, a printer, and/or the like.

The computational system 1600 may further include (and/or be in communication with) one or more storage devices 1608, which can comprise, without limitation, local and/or network accessible storage and/or can include, without limitation, a disk drive, a drive array, an optical storage device, solid-state storage device such as a random access memory ("RAM"), and/or a read-only memory ("ROM"), which can be programmable, flash-updateable, and/or the like. The computational system 1600 might also include a communications subsystem 1614, which can include without limitation a modem, a network card (wireless or wired), an infra-red communication device, a wireless communication device and/or chipset (such as a Bluetooth device, an 802.11 device, a WiFi device, a WiMax device, cellular communication facilities, etc.), and/or the like. The communications subsystem 1614 may permit data to be exchanged with a network (such as the network described below, to name one example), and/or any other devices described herein. In many embodiments, the computational system 1600 will further comprise a working memory 1618, which can include a RAM or ROM device, as described above.

The computational system 1600 also may comprise software elements, shown as being currently located within the working memory 1618, including an operating system 1624 and/or other code, such as one or more application programs 1622, which may comprise computer programs of the invention, and/or may be designed to implement methods of the invention and/or configure systems of the invention, as described herein. Merely by way of example, one or more procedures described with respect to the method(s) discussed above might be implemented as code and/or instructions executable by a computer (and/or a processor within a computer). A set of these instructions and/or code might be stored on a computer readable storage medium 1610*b*. In some embodiments, the computer readable storage medium 1610*b* is the storage device(s) 1608 described above. In other embodiments, the computer readable storage medium 1610*b* might be incorporated within a computer system. In still other embodiments, the computer readable storage medium 1610*b* might be separate from the computer system (i.e., a removable medium, such as a compact disc, etc.), and or provided in an installation package, such that the storage medium can be used to program a general purpose computer with the instructions/code stored thereon. These instructions might take the form of executable code, which is executable by the computer system 1600 and/or might take the form of source and/or installable code, which, upon compilation and/or installation on the computer system 1600 (e.g., using any of a variety of generally available compilers, installation programs, compression/decompression utilities, etc.), then takes the form of executable code. In these embodiments, the computer readable storage medium 1610*b* may be read by a computer readable storage media reader 1610*a*.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

In some embodiments, one or more of the input devices 1604 may be coupled with an audio interface 1630. The audio interface 1630 may be configured to interface with a microphone, instrument, digital audio device, or other audio signal or file source, for example physically, optically, electromagnetically, etc. Further, in some embodiments, one or more of the output devices 1606 may be coupled with a source transcription interface 1632. The source transcription interface 1632 may be configured to output musical score representation data generated by embodiments of the invention to one or more systems capable of handling that data. For example, the source transcription interface may be configured to interface with score transcription software, score publication systems, speakers, etc.

In one embodiment, the invention employs a computer system (such as the computational system 1600) to perform methods of the invention. According to a set of embodiments, some or all of the procedures of such methods are performed by the computational system 1600 in response to processor 1602 executing one or more sequences of one or more instructions (which might be incorporated into the operating system 1624 and/or other code, such as an application program 1622) contained in the working memory 1618. Such instructions may be read into the working memory 1618 from another machine-readable medium, such as one or more of the storage device(s) 1608 (or 1610). Merely by way of example, execution of the sequences of instructions contained in the working memory 1618 might cause the processor(s) 1602 to perform one or more procedures of the methods described herein.

The terms "machine readable medium" and "computer readable medium," as used herein, refer to any medium that participates in providing data that causes a machine to operate in a specific fashion. In an embodiment implemented using the computational system 1600, various machine-readable media might be involved in providing instructions/code to processor(s) 1602 for execution and/or might be used to store and/or carry such instructions/code (e.g., as signals). In many implementations, a computer readable medium is a physical and/or tangible storage medium. Such a medium may take many forms, including but not limited to, non-volatile media, volatile media, and transmission media. Non-volatile media includes, for example, optical or magnetic disks, such as the storage device(s) (1608 or 1610). Volatile media includes, without limitation, dynamic memory, such as the working memory 1618. Transmission media includes coaxial cables, copper wire, and fiber optics, including the wires that comprise the bus 1626, as well as the various components of the communication subsystem 1614 (and/or the media by which the communications subsystem 1614 provides communication with other devices). Hence, transmission media can also take the form of waves (including, without limitation, radio, acoustic, and/or light waves, such as those generated during radio-wave and infra-red data communications).

Common forms of physical and/or tangible computer readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, an EPROM, a FLASH-EPROM, any other memory chip or cartridge, a carrier wave as described hereinafter, or any other medium from which a computer can read instructions and/or code.

Various forms of machine-readable media may be involved in carrying one or more sequences of one or more instructions to the processor(s) 1602 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computational system 1600. These signals, which might be in the form of electromagnetic signals, acoustic signals, optical signals, and/or the like, are all examples of carrier waves on which instructions can be encoded, in accordance with various embodiments of the invention.

The communications subsystem 1614 (and/or components thereof) generally will receive the signals, and the bus 1626 then might carry the signals (and/or the data, instructions, etc. carried by the signals) to the working memory 1618, from which the processor(s) 1602 retrieves and executes the instructions. The instructions received by the working memory 1618 may optionally be stored on a storage device 1608 either before or after execution by the processor(s) 1602.

Other Capabilities

It will be appreciated that many other processing capabilities are possible in addition to those described above. One set of additional processing capabilities involves increasing the amount of customizability that is provided to a user. For example, embodiments may allow for enhanced customizability of various components and methods of the invention.

In some embodiments, the various thresholds, windows, and other inputs to the components and methods may each be adjustable for various reasons. For example, the user may be able to adjust the key extraction window, if it appears that key determinations are being made too often (e.g., the user may not want brief departures from the key to show up as a key change on the score). For another example, a recording may include a background noise coming from 60 Hz power used during the performance on the recording. The user may wish to adjust various filter algorithms to ignore this 60 Hz pitch, so as not to represent it as a low note on the score. In still another example, the user may adjust the resolution of musical bins into which pitches are quantized to adjust note pitch resolution.

In other embodiments, less customizability may be provided to the user. In one embodiment, the user may be able to adjust a representational accuracy level. The user may input (e.g., via a physical or virtual slider, knob, switch, etc.) whether the system should generate more accurate or less accurate score representations, based on one or more parameter, including selecting the accuracy for individual score-representational elements, like tempo and pitch.

For example, a number of internal settings may work together so that the minimum note value is a sixteenth note. By adjusting the representational accuracy, longer or shorter durations may be detected and represented as the minimum value. This may be useful where a performer is not performing strictly to a constant beat (e.g., there is no percussion section, no metronome, etc.), and too sensitive a system may yield undesirable representations (e.g., triple-dotted notes). As another example, a number of internal settings may work together so that the minimum pitch change is a half-step (i.e., notes on the chromatic scale).

In still other embodiments, even less customizability may be provided to the user. In one embodiment, the user may input whether he or she is a novice user or an advanced user. In another embodiment, the user may input whether the system should have high or low sensitivity. In either embodiment, many different parameters in many components or methods may adjust together to fit the desired level. For example, in one case, a singer may wish to accurately transcribe every waver in pitch and duration (e.g., as a practice aid to find mistakes, or to faithfully reproduce a specific performance with all its aesthetic subtleties); while in another case, the singer may wish to generate an easy to read score for publication by having the system ignore small deviations.

Another set of additional processing capabilities involves using different types of input to refine or otherwise affect the processing of the input audio signal. One embodiment uses one or more trained artificial neural networks (ANN's) to refine certain determinations. For example, psycho-acoustical determinations (e.g., meter, key, instrumentation, etc.) may be well-suited to using trained ANN's.

Another embodiment provides the user with the ability to layer multiple tracks (e.g., a one-man band). The user may begin by performing a drum track, which is processed in real time using the system of the invention. The user may then serially perform a guitar track, a keyboard track, and a vocal track, each of which is processed. In some cases, the user may select multiple tracks to process together, while in other cases, the user may opt to have each track processed separately. The information from some tracks may then be used to refine or direct the processing of other tracks. For example, the drum track may be independently processed to generate high-confidence tempo and meter information. The tempo and meter information may then be used with the other tracks to more accurately determine note durations and note values. For another example, the guitar track may provide many pitches over small windows of time, which may make it easier to determine key. The key determination may then be used to assign key pitch determinations to the notes in the keyboard track. For yet another example, the multiple tracks may be aligned, quantized, or normalized in one or more dimension (e.g., the tracks may be normalized to have the same tempo, average volume, pitch range, pitch resolution, minimum note duration, etc.). Further, in some embodiments of the "one-man band", the user may use one instrument to generate the audio signal, then use the system or methods to convert to a different instrument or instruments (e.g., play all four tracks of a quartet using a keyboard, and use the system to convert the keyboard input into a string quartet). In some cases, this may involve adjusting the timbre, transposing the musical lines, and other processing.

Still another embodiment uses inputs extrinsic to the audio input signal to refine or direct the processing. In one embodiment, genre information is received either from a user, from another system (e.g., a computer system or the Internet), or from header information in the digital audio file to refine various cost functions. For example, key cost functions may be different for blues, Indian classical, folk, etc.; or different instrumentation may be more likely in different genres (e.g. an "organ-like" sound may be more likely an organ in hymnal music and more likely an accordion in Polka music).

A third set of additional processing capabilities involves using information across multiple components or methods to refine complex determinations. In one embodiment, the output of the instrument identification method is used to refine determinations based on known capabilities or limitations of the identified instruments. For example, say the instrument identification method determines that a musical line is likely being played by a piano. However, the pitch identification method determines that the musical line contains rapid, shallow vibrato (e.g., warbling of the pitch within only one or two semitones of the detected key pitch designation). Because this is not typically a possible effect to produce on a piano, the system may determine that the line is being played by another instrument (e.g., an electronic keyboard or an organ).

It will be appreciated that many such additional processing capabilities are possible, according to the invention. Further, it should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments. Further, the headings provided herein are intended merely to aid in the clarity of the descriptions of various embodiments, and should not be construed as limiting the scope of the invention or the functionality of any part of the invention. For example, certain methods or components may be implemented as part of other methods or components, even though they are described under different headings.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

What is claimed is:

1. A method of generating key data from an audio signal, the method comprising:

determining a set of cost functions, each cost function being associated with a key and representing a fit of each of a set of predetermined frequencies to the associated key;

determining a key extraction window, representing a contiguous portion of the audio signal extending from a first time location to a second time location;

generating a set of note onset events by locating the note onset events occurring within the contiguous portion of the audio signal;

determining a note frequency for each of the set of note onset events;

generating a set of key error values based on evaluating the note frequencies against each of the set of cost functions; and determining a received key, wherein the received key is the key associated with the cost function that generated the lowest key error value.

2. The method of claim 1, further comprising:

generating a set of reference pitches, each reference pitch representing a relationship between one of the set of predetermined pitches and the received key; and determining a key pitch designation for each note onset event, the key pitch designation representing the reference pitch that best approximates the note frequency of the note onset event.

3. The method of claim 1, wherein determining the note frequency for each of the set of note onset events comprises:

extracting a set of note sub-windows, each note sub-window representing a portion of the contiguous portion of the audio signal extending for a determined note duration from a note onset occurring during the key extraction window; and extracting a set of note frequencies, each note frequency being a frequency of the portion of the audio signal occurring during one of the set of note sub-windows.

4. The method of claim 3, wherein the frequency of the portion of the audio signal occurring during one of the set of note sub-windows is the fundamental frequency.

5. The method of claim 1, further comprising:

receiving genre information relating to the audio signal; and generating the set of cost functions based in part on the genre information.

6. The method of claim 1, further comprising:

determining a plurality of key extraction windows;

determining a received key for each key extraction window;

determining a key pattern from the received keys; and refining the set of cost functions based in part on the key pattern.

* * * * *